US008159285B2

(12) United States Patent
Hioka et al.

(10) Patent No.: US 8,159,285 B2
(45) Date of Patent: Apr. 17, 2012

(54) CURRENT SUPPLY CIRCUIT

(75) Inventors: Takeshi Hioka, Kawasaki (JP); Ryu Ogiwara, Yokohama (JP); Daisaburo Takashima, Yokohama (JP)

(73) Assignee: Kabushiki Kaisha Toshiba (JP)

( * ) Notice: Subject to any disclaimer, the term of this patent is extended or adjusted under 35 U.S.C. 154(b) by 170 days.

(21) Appl. No.: 12/729,169

(22) Filed: Mar. 22, 2010

(65) Prior Publication Data

US 2010/0237933 A1 Sep. 23, 2010

(30) Foreign Application Priority Data

Mar. 23, 2009 (JP) ..... 2009-70151
Mar. 4, 2010 (JP) ..... 2010-47657

(51) Int. Cl.
*G05F 1/10* (2006.01)

(52) U.S. Cl. ..... 327/543

(58) Field of Classification Search ..... 323/315, 323/316, 317; 327/403, 404, 405, 535, 537, 327/538, 540, 543
See application file for complete search history.

(56) References Cited

U.S. PATENT DOCUMENTS 7,193,403 B2 * 3/2007 Sudoh et al. ..... 323/313
7,414,458 B2 * 8/2008 Wu et al. ..... 327/540
7,880,531 B2 * 2/2011 Park ..... 327/538
7,944,280 B2 * 5/2011 Gabillard et al. ..... 327/538

OTHER PUBLICATIONS

Seishiro Murata, "Design of Analog CMOS integrated Circuits," Maruzen Company Limited, Mar. 30, 2003, pp. 356-440.

* cited by examiner

*Primary Examiner* — Jeffrey Zweizig
(74) *Attorney, Agent, or Firm* — Knobbe, Martens, Olson & Bear LLP

(57) ABSTRACT

A current supply circuit according to an embodiment of the present invention includes an operational amplifier having first and second input terminals and an output terminal, a transistor having a control terminal connected to the output terminal of the operational amplifier, and having first and second main terminals, a first resistance arranged between the first input terminal of the operational amplifier and the first main terminal of the transistor, a second resistance arranged between a predetermined node and a ground line, the predetermined node being between the first input terminal of the operational amplifier and the first resistance, first to Nth transistors, each of which has a control terminal connected to the control terminal or the second main terminal of the transistor, and has a main terminal outputting a current, where N is an integer of two or larger, and first to Nth switching transistors, each of which has a main terminal, the main terminals of the first to Nth switching transistors being respectively connected to the main terminals of the first to Nth transistors, a pulse width of a signal provided to a control terminal of the respective first to Nth switching transistors being set to be constant regardless of a pulse frequency of the signal.

20 Claims, 21 Drawing Sheets

CURRENT SUPPLY CIRCUIT

CROSS REFERENCE TO RELATED APPLICATION

This application is based upon and claims the benefit of priority from the prior Japanese Patent Applications No. 2009-70151, filed on Mar. 23, 2009 and No. 2010-47657, filed on Mar. 4, 2010, the entire contents of which are incorporated herein by reference.

BACKGROUND OF THE INVENTION

1. Field of the Invention

The present invention relates to a current supply circuit, for example, to be used for supplying a current for generating a supply voltage.

2. Background Art

A current supply circuit for supplying a large current includes, for example, a kicker controller including an operational amplifier of a feedback system and a subsequent current amplifier which is a transistor, and a kicker configured to output a current. In such a circuit, when a high voltage is inputted to a drain side of the current amplifier, an output of the operational amplifier becomes a low voltage. Then, when a low voltage is inputted to the drain side of the current amplifier, it takes a long time until the output of the operational amplifier becomes stable. Accordingly, a required time until an operation of the entire circuit becomes long, resulting in a problem of an inferior responsiveness of the current supply circuit. Further, there has been a problem that a current to be obtained is shifted from a desired value in corner conditions.

Further, as another example of the current supply circuit for supplying a large current, there has been a current supply circuit using a voltage supply. In such a circuit, power consumption tends to be decreased compared to the above mentioned current supply circuit. However, a required time until a voltage of the voltage supply is controlled to be a desired value is long, resulting in an inferior responsibility. Further, in such a case as well, there has been a problem that a current to be obtained is shifted from a desired value in corner conditions.

Further, in the current supply circuit including the kicker controller and the kicker, there has been a problem that a current flowing through a transistor of the kicker controller side cannot be mirrored correctly to a current flowing through a transistor of the kicker side in some cases when a large current is controlled. This problem becomes remarkable particularly when the inputted voltage at the drain side of the current amplifier becomes high, so that a sufficient current necessary for a circuit operation cannot be supplied. In order to solve such problems, a degree of flexibility to control a current and a voltage in the circuit is required to appropriately set the current flowing through the transistor of the kicker side.

A document "Behzad Razavi, "Design of Analog CMOS integrated Circuits", Original edition copyright 2001 by The McGraw-Hill Companies, Inc." is an example of the related art of the present application.

SUMMARY OF THE INVENTION

An aspect of the present invention is, for example, a current supply circuit including an operational amplifier having first and second input terminals and an output terminal, a transistor having a control terminal connected to the output terminal of the operational amplifier, and having first and second main terminals, a first resistance arranged between the first input terminal of the operational amplifier and the first main terminal of the transistor, a second resistance arranged between a predetermined node and a ground line, the predetermined node being between the first input terminal of the operational amplifier and the first resistance, first to Nth transistors, each of which has a control terminal connected to the control terminal or the second main terminal of the transistor, and has a main terminal outputting a current, where N is an integer of two or larger, and first to Nth switching transistors, each of which has a main terminal, the main terminals of the first to Nth switching transistors being respectively connected to the main terminals of the first to Nth transistors, a pulse width of a signal provided to a control terminal of the respective first to Nth switching transistors being set to be constant regardless of a pulse frequency of the signal.

Another aspect of the present invention is, for example, a current supply circuit including an operational amplifier having first and second input terminals and an output terminal, a switching transistor having a control terminal and first and second main terminals, a first resistance arranged between the first input terminal of the operational amplifier and the first or second main terminal of the switching transistor, a second resistance arranged between a predetermined node and a ground line, the predetermined node being between the first input terminal of the operational amplifier and the first resistance, first to Nth transistors, each of which has a control terminal connected to the output terminal of the operational amplifier, and has a main terminal outputting a current, where N is an integer of two or larger, and first to Nth switching transistors, each of which has a main terminal, the main terminals of the first to Nth switching transistors being respectively connected to the main terminals of the first to Nth transistors, a pulse width of a signal provided to a control terminal of the respective first to Nth switching transistors being set to be constant regardless of a pulse frequency of the signal.

Another aspect of the present invention is, for example, a current supply circuit including an operational amplifier having first and second input terminals and an output terminal, a transistor having a control terminal connected to the output terminal of the operational amplifier, and having first and second main terminals, a first resistance arranged between the first input terminal of the operational amplifier and the first main terminal of the transistor, a second resistance arranged between a predetermined node and a ground line, the predetermined node being between the first input terminal of the operational amplifier and the first resistance, a third resistance arranged between another predetermined node and the ground line, the another predetermined node being between the first resistance and the first main terminal of the transistor, first to Nth transistors, each of which has a control terminal connected to the control terminal or the second main terminal of the transistor, and has a main terminal outputting a current, where N is an integer of two or larger, and first to Nth switching transistors, each of which has a main terminal, the main terminals of the first to Nth switching transistors being respectively connected to the main terminals of the first to Nth transistors.

Another aspect of the present invention is, for example, a current supply circuit including a kicker controller configured to output a pulse voltage, a kicker including first to Nth transistors, each of which has a main terminal outputting a current, and first to Nth switching transistors, each of which has a main terminal, the main terminals of the first to Nth switching transistors being respectively connected to the main terminals of the first to Nth transistors, where N is an integer of two or larger, a delay locked loop circuit to which an external clock is inputted and which is configured to output an internal clock synchronized with the external clock, and a switching circuit configured to switch between supplying and not supplying the internal clock to the kicker, based on the pulse voltage, the switching circuit supplying the internal clock to a control terminal of the respective first to Nth transistors.

DESCRIPTION OF THE EMBODIMENTS

Embodiments of the present invention will be described below with reference to the accompanying drawings.

First Embodiment

Figure 1:
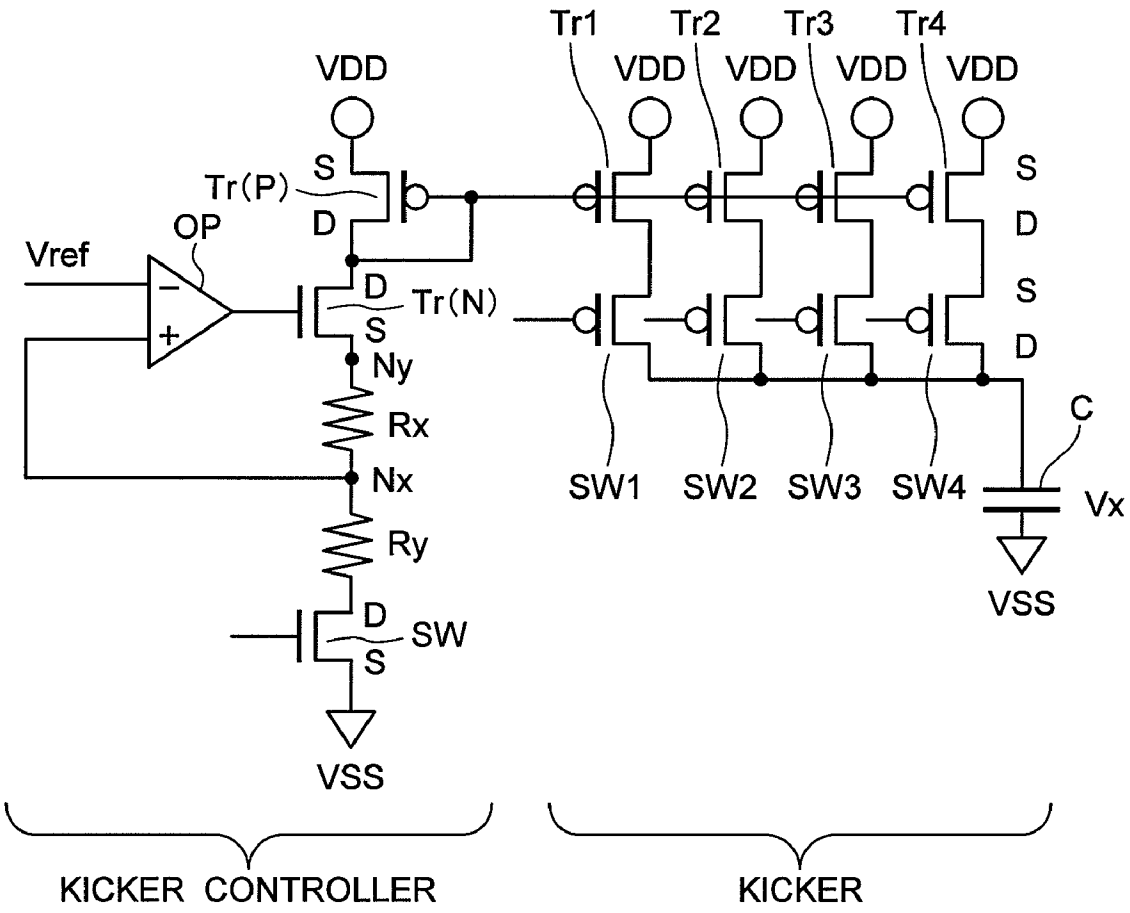
FIG. 1 is a circuit diagram schematically illustrating a configuration of a current supply circuit of a first embodiment.

FIG. 1 is a circuit diagram schematically illustrating a configuration of a current supply circuit of a first embodiment. As illustrated in FIG. 1, the current supply circuit of the present embodiment includes a kicker controller (kicker controller circuit) and a kicker (kicker circuit).

First, the configuration of the kicker controller will be described.

The kicker controller of FIG. 1 includes an operational amplifier OP, an NMOS transistor Tr(N), a PMOS transistor Tr(P), a first resistance Rx, a second resistance Ry, and a switching transistor SW which is an NMOS.

In FIG. 1, an output terminal of the operational amplifier OP is connected to a gate terminal of the NMOS transistor Tr(N), and a plus input terminal of the operational amplifier OP is connected to a source terminal of the NMOS transistor Tr(N) via the resistance Rx. Further, a reference potential Vref is supplied to a minus input terminal of the operational amplifier OP. Further, a drain terminal of the NMOS transistor Tr(N) is connected to a drain terminal of the PMOS transistor Tr(P), and a source terminal of the PMOS transistor Tr(P) is connected to a power line VDD.

As described above, the kicker controller in FIG. 1 includes the operation amplifier of a feedback system. The operation amplifier OP is an example of an operation amplifier of the present invention. The NMOS transistor Tr(N) is an example of a transistor of the present invention. The PMOS transistor Tr(P) is an example of a further transistor of the present invention. Further, the plus and minus input terminals of the operation amplifier OP are respectively examples of first and second input terminals of the present invention. The gate, source, and drain terminals of the NMOS transistor Tr(N) are respectively examples of control, first main, and second main terminals of the present invention. The gate, source, and drain terminals of the PMOS transistor Tr(P) are respectively examples of control, second main, and first main terminals of the present invention.

In FIG. 1, the first resistance Rx, the second resistance Ry, and the switching transistor SW are further illustrated. The resistance Rx is arranged between the plus input terminal of the operational amplifier OP and the source terminal of the NMOS transistor Tr(N). Further, the resistance Ry and the switching transistor SW are connected in series to each other and arranged between a node Nx and the ground line VSS. The node Nx is between the plus input terminal of the operational amplifier OP and the resistance Rx. The node Nx is an example of a predetermined node of the present invention.

Next, the configuration of the kicker will be described.

The kicker in FIG. 1 includes first to fourth transistors Tr1 to Tr4 which are PMOSs, and first to fourth switching transistors SW1 to SW4 which are PMOSs. The kicker in FIG. 1 is connected to a capacitor C.

Gate terminals of the transistors Tr1 to Tr4 are connected to the drain terminal of the transistor Tr(N) and the gate and drain terminals of the transistor Tr(P). Further, source terminals of the transistors Tr1 to Tr4 are connected to the power line VDD. Further, drain terminals of the transistors Tr1 to Tr4 are connected respectively to source terminals of the switching transistors SW1 to SW4. Furthermore, drain terminals of the switching transistors SW1 to SW4 are connected to the capacitor C.

Each of the transistors Tr1 to Tr4 output a current from a drain terminal. The currents outputted from the transistors Tr1 to Tr4 respectively pass through the switching transistors SW1 to SW4, and are accumulated in the capacitor C. Accordingly, a capacitor voltage Vx as an output voltage is generated between electrodes of the capacitor C. The current supply circuit of the present embodiment is configured to supply a current for generating a supply voltage, for example. In this case, the above mentioned voltage is used for a supply voltage.

The transistors Tr1 to Tr4 are examples of first to Nth transistors of the present invention, where N is an integer of two or larger. The switching transistors SW1 to SW4 are examples of first to Nth switching transistors of the present invention. Further, the gate terminals of those transistors are examples of control terminals of the present invention, and the source and drain terminals of those transistors are examples of main terminals of the present invention. Although N is four in the present embodiment, N may be another integer of being two or larger.

As described above, the kicker in FIG. 1 includes the transistors Tr1 to Tr4 and the switching transistors SW1 to SW4. In the present embodiment, the transistors Tr1 to Tr4 output the currents of I, I/2, I/4, and I/8 respectively, where I is an arbitrary real number other than zero. Accordingly, in the present embodiment, the capacitor voltage Vx can be generated in sixteen ($=2^4$) different values by an ON/OFF operation of the switching transistors SW1 to SW4.

Further, in the present embodiment, the kicker may include N pieces of transistors and N pieces of switching transistors, and the N pieces of transistors may output the currents of I to $I/2^{N-1}$ respectively. In other words, the Kth transistor among the N pieces of transistors may output the current of $I/2^{K-1}$, where K is an arbitrary integer between 1 to N inclusive. In this case, in the present embodiment, the capacitor voltage Vx can be generated in $2^N$ different values by an ON/OFF operation of the N pieces of switching transistors.

Next, based on the above description, the configuration and operation of the current supply circuit of FIG. 1 will be described in detail.

The present embodiment adopts a method to input the reference potential Vref to the minus input terminal of the operational amplifier OP to control a potential of a node Ny. The node Ny is between the resistance Rx and the source terminal of the NMOS transistor Tr(N). In the present embodiment, when the voltage of the node Ny becomes high, the input voltage to the plus input terminal of the operational amplifier OP becomes high, and the output voltage of the operational amplifier OP becomes low.

Further, in the present embodiment, the resistance Ry which is a variable resistance is arranged between the node Nx and the ground line VSS. In the present embodiment, the current flowing through the PMOS transistor Tr(P) can be controlled by trimming the resistance Ry. Accordingly, in the present embodiment, a variation of the output voltage of the operational amplifier OP can be suppressed to be small. In the present embodiment, since the operational amplifier OP is always kept ON, the operational amplifier OP is not required to be controlled afresh for discharging charges accumulated at the switching transistors SW1 to SW4. Therefore, the current supply circuit having excellent responsibility can be actualized.

Further, in the present embodiment, the switching transistors SW1 to SW4 are arranged at the drain terminal side of the transistors Tr1 to Tr4. In the present embodiment, the current supply amount can be adjusted in the kicker while appropriately controlling a current supply timing by switching of the switching transistors SW1 to SW4. In the present embodiment, by combining trimmings of the resistance Ry and the switching transistors SW1 to SW4, a desired current value can be obtained not only in typical conditions but also in corner conditions.

Further, in the present embodiment, a pulse width of a signal provided to the gate terminal of the respective switching transistors SW1 to SW4 is set to be constant regardless of a pulse frequency of the signal. In other words, the pulse width of the signal is constant being independent from the pulse frequency of the signal. Accordingly, in the present embodiment, even when the operation frequency of the current supply circuit (i.e., an alternating-current frequency of the supply voltage, in the present embodiment) is varied, constant charges can be supplied to the capacitor C for each pulse. In this manner, the current supply circuit can appropriately deal with a variation of the operation frequency. The responsibility when the above mentioned signal is input to the gate terminals of the switching transistors SW1 to SW4 is in a range of 1.0 to 2.5 ns, for example. Hence, the responsibility against the switching transistors SW1 to SW4 is excellent as well.

Figure 2:
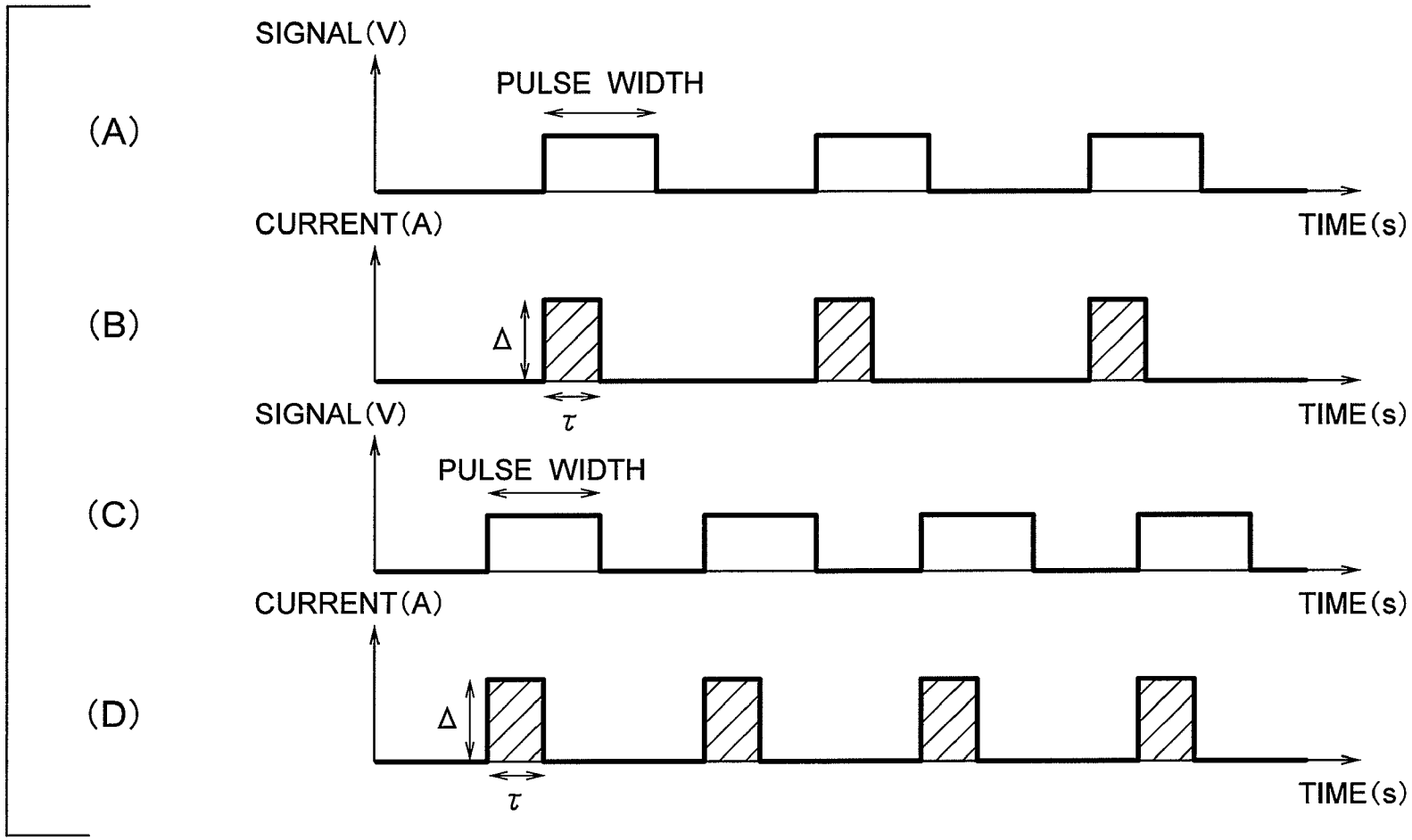
FIG. 2 shows waveform diagrams illustrating signals inputted into gate terminals of switching transistors SW1 to SW4 and currents outputted from drain terminals of transistors Tr1 to Tr4.

FIG. 2 shows waveform diagrams illustrating the signals inputted into the gate terminals of the switching transistors SW1 to SW4 and the currents outputted from the drain terminals of the transistors Tr1 to Tr4.

FIGS. 2(A) and 2(C) respectively indicate waveforms of the signals input to the gate terminals of the switching transistors SW1 to SW4. The waveform of FIG. 2(A) corresponds to a case that the pulse frequency of the signals is low, and the waveforms of FIG. 2(C) corresponds to a case that the pulse frequency of the signals is high.

Further, FIGS. 2(B) and 2(D) indicate waveforms of the current output from the drain terminals of the transistors Tr1 to Tr4 when the pulse frequency is respectively given as illustrated in FIGS. 2(A) and 2(C). As illustrated in FIGS. 2(B) and 2(D), the magnitude $\Delta$ of the current and a current flowing time $\tau$ are constant regardless of the pulse frequency.

Accordingly, in the present embodiment, when the pulse frequency is increased by $\alpha$-times (where $\alpha$ is an arbitrary positive real number), the charge amount accumulated in the capacitor C per unit time is increased by $\alpha$-times as well and the variation rate of the capacitor voltage Vx is enlarged by $\alpha$-times as well. Therefore, in the present embodiment, by increasing the pulse frequency by $\alpha$-times, the operation frequency of the current supply circuit can be increased by $\alpha$-times. In this manner, according to the present embodiment, the current supply circuit having excellent responsibility against the variation of the operation frequency can be actualized.

In FIG. 2, the signals input to the gate terminals of the switching transistors SW1 to SW4 and the currents output from the drain terminals of the transistors Tr1 to Tr4 are described uniformly. However, to be more precise, different signals having the same pulse width are input respectively to the gate terminals of the switching transistors SW1 to SW4. Then, the currents having different current values are output from the drain terminals of the transistors Tr1 to Tr4. However, the differences are simply quantitative not qualitative. Therefore, it should be noted that the above description on FIG. 2 is suitable for each of the cases.

As described above, the current supply circuit of the present embodiment includes the operational amplifier OP, the NMOS transistor Tr(N), the first resistance Rx, the second resistance Ry, the first to fourth transistors Tr1 to Tr4, the first to fourth switching transistors SW1 to SW4 and the like, and the pulse width of the signal provided to the gate terminal of the respective switching transistors SW1 to SW4 is set to be constant regardless of the pulse frequency of the signal. Accordingly, the present embodiment can provide a current supply circuit having excellent responsibility, in particular, having excellent responsibility against the variation of the operation frequency.

In the following, current supply circuits of second to eighth embodiments will be described. Since those embodiments are modifications of the first embodiment, differences from the first embodiment are mainly described in the following.

Second Embodiment

Figure 3:
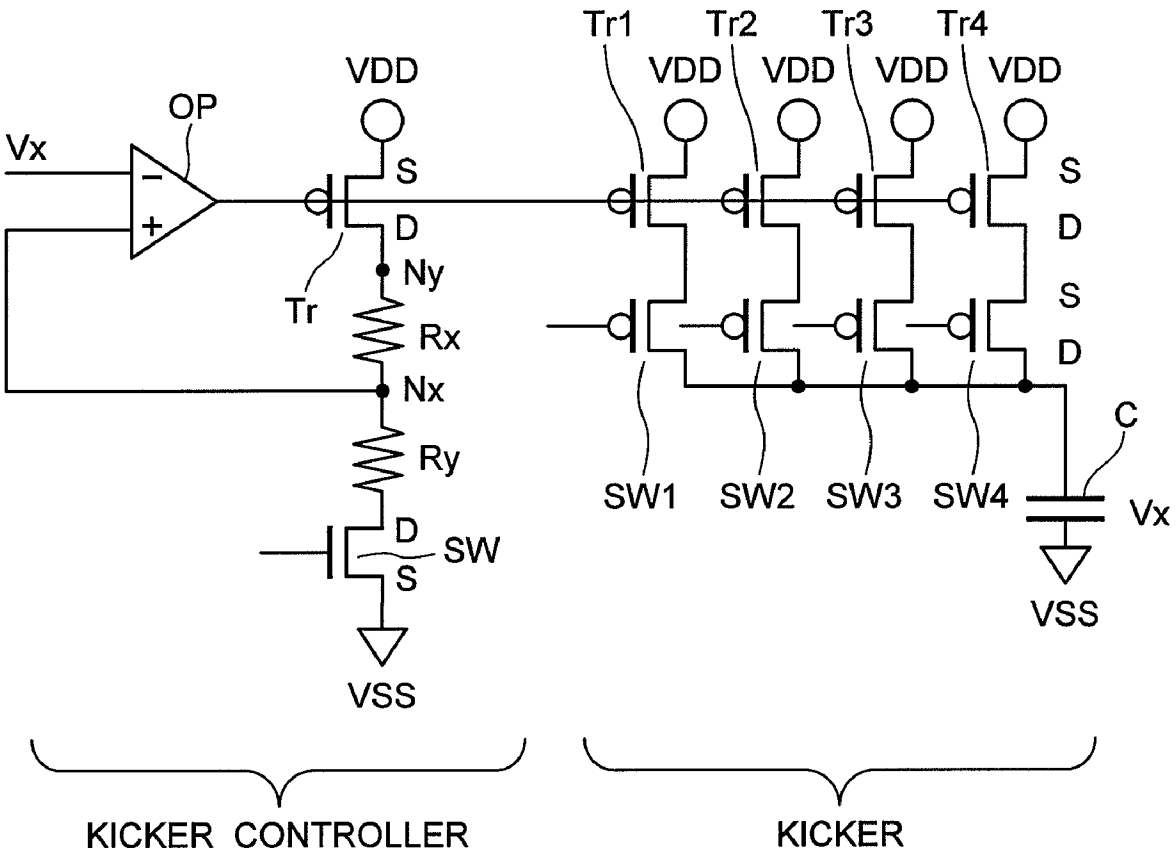
FIG. 3 is a circuit diagram schematically illustrating a configuration of a current supply circuit of a second embodiment.

FIG. 3 is a circuit diagram schematically illustrating a configuration of a current supply circuit of a second embodiment.

In the present embodiment, the NMOS transistor Tr(N) and the PMOS transistor Tr(P) of the first embodiment are replaced with a transistor Tr which is a PMOS. The transistor Tr is an example of a transistor of the present invention.

In FIG. 3, the output terminal of the operational amplifier OP is connected to a gate terminal of the transistor Tr and the plus input terminal of the operational amplifier OP is connected to a drain terminal of the transistor Tr via the resistance Rx. Further, a source terminal of the transistor Tr is connected to the power line VDD. Further, the gate terminals of the first to fourth transistors Tr1 to Tr4 are connected to the gate terminal of the transistor Tr. The gate, source, and the drain terminals are examples of the control, second main, and first main terminals of the present invention.

Next, based on the above description, the configuration and operation of the current supply circuit of FIG. 3 will be described in detail.

In the first embodiment, the reference potential Vref independent from the capacitor voltage Vx is supplied to the minus input terminal of the operational amplifier OP. Meanwhile, in the present embodiment, the voltage having the same value as that of the voltage to be generated between the electrodes of the capacitor C is supplied to the minus input terminal of the operational amplifier OP. In other words, in the present embodiment, the capacitor voltage Vx is supplied to the minus input terminal of the operational amplifier OP. In the present embodiment, since the reference potential Vref having a different value from that of the capacitor voltage Vx is not required to be generated, simplification of the entire circuit configuration and reduction of power consumption can be achieved. In addition, effects such as acceleration of designing time and improvement of cost-efficiency can be obtained.

Further, in the first embodiment, the resistance Ry is a variable resistance. Meanwhile, in the present embodiment, the resistance Ry is a fixed resistance. Accordingly, a chip area can be reduced in the present embodiment.

Further, in the present embodiment, similar to the first embodiment, the switching transistors SW1 to SW4 are disposed respectively at the drain terminal side of the transistors Tr1 to Tr4. Then, the pulse width of the signal provided to the gate terminal of the respective switching transistors SW1 to SW4 is set to be constant regardless of the pulse frequency of the signal. Accordingly, the effects as similar to those obtained in the first embodiment regarding the switching transistors SW1 to SW4 can be obtained in the present embodiment.

Accordingly, similar to the first embodiment, the present embodiment can provide a current supply circuit having excellent responsibility, in particular, having excellent responsibility against the variation of the operation frequency. Further, in the present embodiment, since the reference potential Vref having a different value from that of the capacitor voltage Vx is not required to be generated, simplification of the entire circuit configuration and reduction of power consumption can be achieved.

In the following, first and second modifications of the current supply circuit of the second embodiment will be described.

Figure 4:
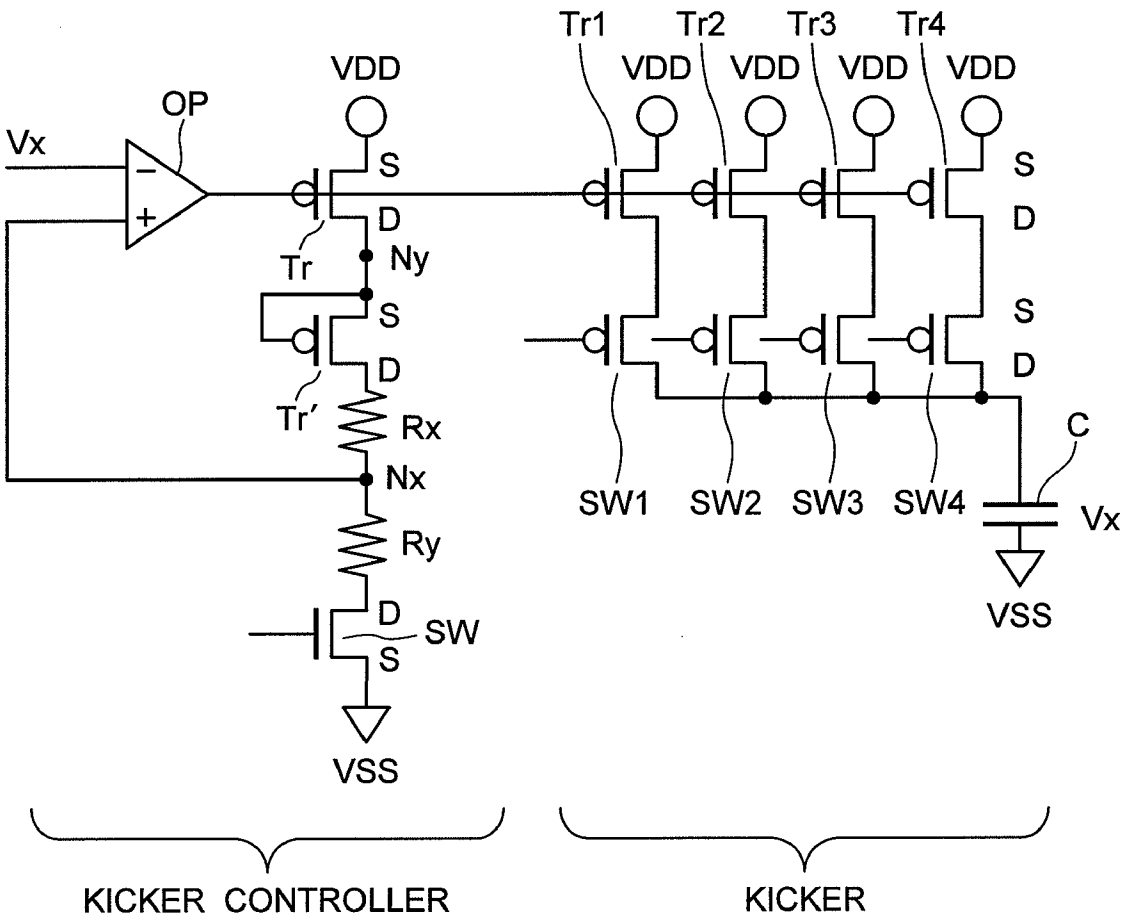
FIGS. 4 and 5 are circuit diagrams schematically illustrating configurations of current supply circuits of first and second modifications of the second embodiment, respectively.

FIG. 4 is a circuit diagram schematically illustrating a configuration of a current supply circuit of the first modification of the second embodiment.

In the present modification, a PMOS transistor Tr' is inserted between the node Ny and the resistance Rx illustrated in FIG. 3. A gate terminal and a source terminal of the PMOS transistor Tr' are connected to the drain terminal of the PMOS transistor Tr and a drain terminal of the PMOS transistor Tr' is connected to the resistance Rx. The transistor Tr' is an example of a further transistor of the present invention. The gate, the source, and the drain terminals of the transistor Tr' are examples of the control, first main, and second main terminals of the present invention.

First, according to the PMOS transistor Tr, the ON resistances of the transistors at the kicker controller side can be matched with the ON resistances of the transistors on the kicker side. In FIG. 4, the ON resistance of the transistor Tr corresponds to the ON resistances of the transistors Tr1 to Tr4, and the ON resistance of the transistor Tr' corresponds to the ON resistances of the switching transistors SW1 to SW4

Second, according the PMOS transistor Tr', the W/L values of the transistors at the kicker controller side can be matched with the W/L values of the transistors at the kicker side, similar to the ON resistance case, where W denotes the channel width of the transistors, and L denotes the channel length of the transistors.

In the present modification, instead of the PMOS transistor, an NMOS transistor may be inserted between the node Ny and the resistance Rx illustrated in FIG. 3.

The configuration of inserting a PMOS transistor or an NMOS transistor between the node Ny and the resistance Rx is possible to be adopted not only to the current supply circuit of FIG. 3 but also to later-mentioned current supply circuits of FIGS. 5 to 8, 10, 12, and 14 to 17.

As described above, in the present modification, the ON resistances and the W/L values of the transistors at the kicker controller side can be matched with the ON resistances and the W/L values of the transistors at the kicker side.

Figure 5:
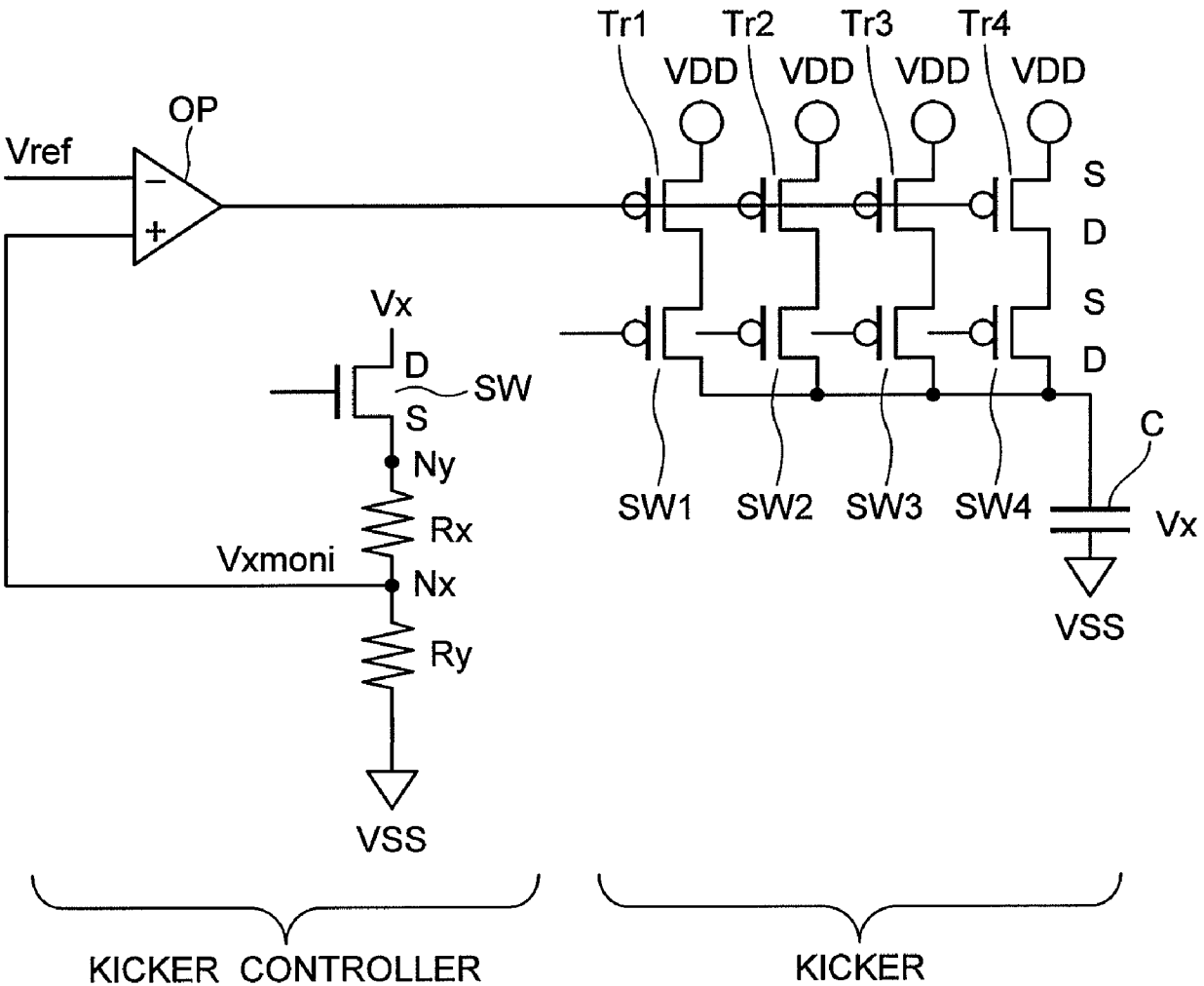

FIG. 5 is a circuit diagram schematically illustrating a configuration of a current supply circuit of the second modification of the second embodiment.

In the present modification, the PMOS transistor Tr illustrated in FIG. 3 is eliminated. Further, the location of the switching transistor SW is shifted. The source terminal of the switching transistor SW is connected to the resistance Rx via the node Nx and the capacitor voltage Vx is supplied to the drain terminal of the switching transistor SW. Further, the input voltage to the minus input terminal of the operational amplifier OP is the reference potential Vref being independent from the capacitor voltage Vx, and the input voltage to the plus input terminal of the operational amplifier OP is a potential Vxmoni at the node Nx. In FIG. 5, Vxmoni is a potential resistively divided by the resistances Rx and Ry. The gate, source, and drain terminals of the switching transistor SW is examples of control, first main, and second main terminals of the present invention.

The current supply circuit of FIG. 5 is configured to directly monitor the capacitor voltage Vx to feed back it to the operational amplifier OP. Further, the resistances Rx, Ry and the potential Vxmoni are set to satisfy the following equation (1):

$$Vxmoni = Vx \times Rx/(R1+R2) = Vref \quad (1).$$

In the current supply circuit of FIG. 5, when the capacitor potential Vx is lower than a target value, the potential Vxmoni drops and the output voltage of the operational amplifier OP drops as well. Accordingly, charges are supplied to the capacitor C. As a result, the capacitor potential Vx rises.

On the other hand, when the capacitor potential Vx is higher than the target value, the potential Vxmoni rises and the output voltage of the operational amplifier OP rises as well. Accordingly, the charge supply to the capacitor C is stopped. As a result, the capacitor potential Vx drops.

The resistances Rx and Ry arranged between the capacitor C and the ground line VSS are controlled by the switching transistor SW. It is necessary that the resistances Rx and Ry are sufficiently charged at the time when the kicker is to be operated. In the present modification, for example, the switching transistor SW is switched on immediately after the kicker becomes into an active state, in order to keep a time longer than the time constant which is the product of the resistances Rx and Ry and a parasitic capacity, until the time when the kicker is shifted from the active state to an enabling state.

As described above, according to the modification, it becomes possible to set the capacitor potential Vx to the target value by feeding back the capacitor potential Vx to the current supply circuit in a different manner from the current supply circuit of FIG. 3.

Third Embodiment

Figure 6:
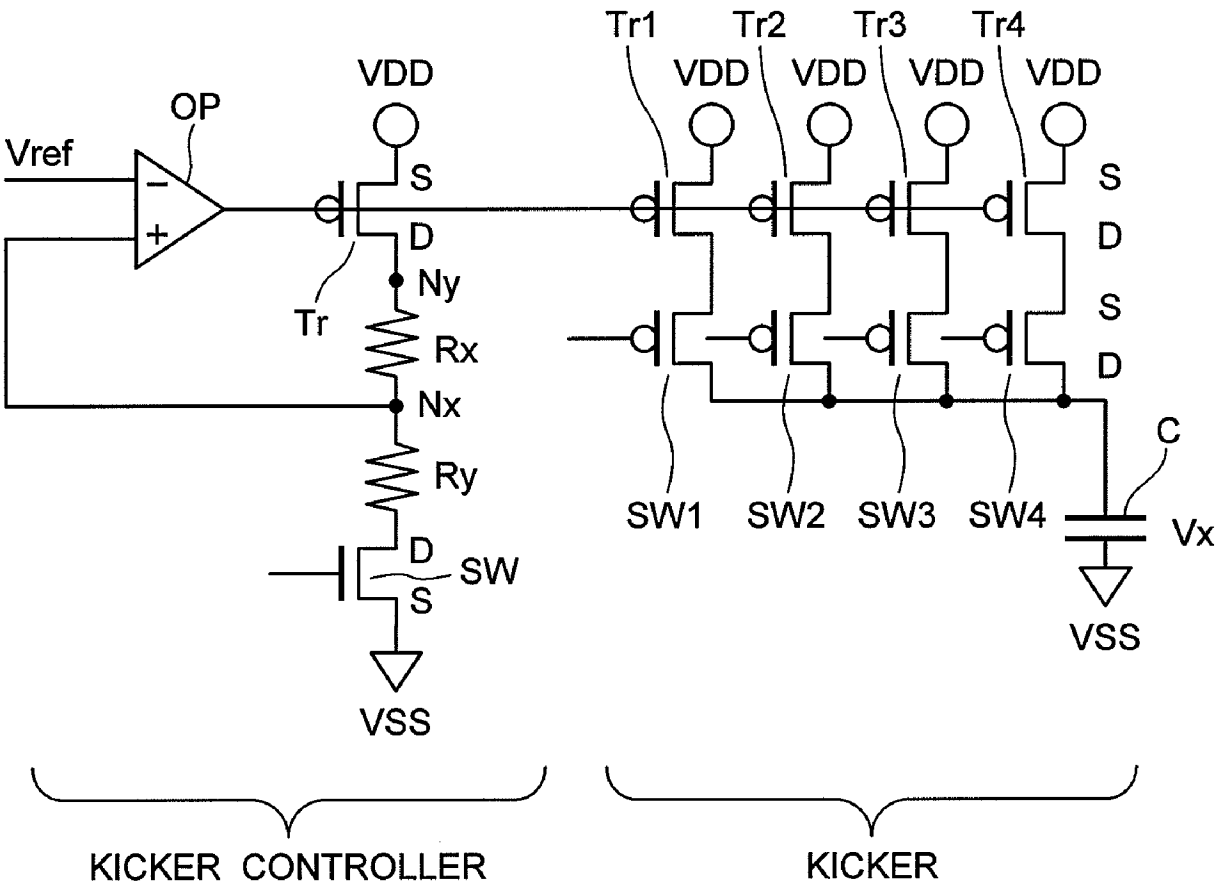
FIG. 6 is a circuit diagram schematically illustrating a configuration of a current supply circuit of a third embodiment.

FIG. 6 is a circuit diagram schematically illustrating a configuration of a current supply circuit of a third embodiment.

In the present embodiment, the NMOS transistor Tr(N) and the PMOS transistor Tr(P) of the first embodiment are replaced with the transistor Tr which is a PMOS. This is similar to the second embodiment. The transistor Tr is an example of the transistor of the present invention.

Next, based on the above description, the configuration and operation of the current supply circuit of FIG. 6 will be described in detail.

In the second embodiment, the capacitor voltage Vx is supplied to the minus input terminal of the operational amplifier OP and the resistance Ry is a fixed resistance. Meanwhile, in the present embodiment, similar to the first embodiment, the reference potential Vref being independent from the capacitor voltage Vx is supplied to the minus input terminal of the operational amplifier OP and the resistance Ry is a variable resistance. Accordingly, in the present embodiment, similar to the first embodiment, the variation of the output voltage of the operational amplifier OP can be suppressed to be small. As a result, a current supply circuit having excellent responsibility can be actualized.

Further, in the present embodiment, similar to the first embodiment, the switching transistors SW1 to SW4 are arranged at the drain terminal side of the transistors Tr1 to Tr4. Further, the pulse width of the signal provided to the gate terminal of the respective switching transistors SW1 to SW4 is set to be constant regardless of the pulse frequency of the signal. Accordingly, in the present embodiment, the effects regarding the switching transistors SW1 to SW4 can be obtained as similar to those obtained in the first embodiment.

Further, in addition to the transistor Tr(N), the transistor Tr(P) is arranged between the operational amplifier OP and the transistors Tr1 to Tr4 in the first embodiment. The transistor Tr(P) is connected so as to be a diode. Meanwhile, in the present embodiment, only the transistor Tr is arranged between the operational amplifier OP and the transistors Tr1 to Tr4.

In the first embodiment, the ratio between the size of the transistor Tr(P) and the total size of the transistors Tr1 to Tr4 largely affects the output current value of the transistors Tr1 to Tr4. On the contrary, in the present embodiment, the output of the operational amplifier OP largely affects the output current value of the transistors Tr1 to Tr4. Accordingly, in the present embodiment, the output currents of the transistors Tr1 to Tr4 can be controlled without significant restriction of the transistor size. This is similar to the second embodiment.

Accordingly, similar to the first embodiment, the present embodiment can provide a current supply circuit having excellent responsibility, in particular, having excellent responsibility against variation of operation frequency. Further, in the present embodiment, the output currents of the transistors Tr1 to Tr4 can be controlled without significant restriction of the transistor size.

Fourth Embodiment

Figure 7:
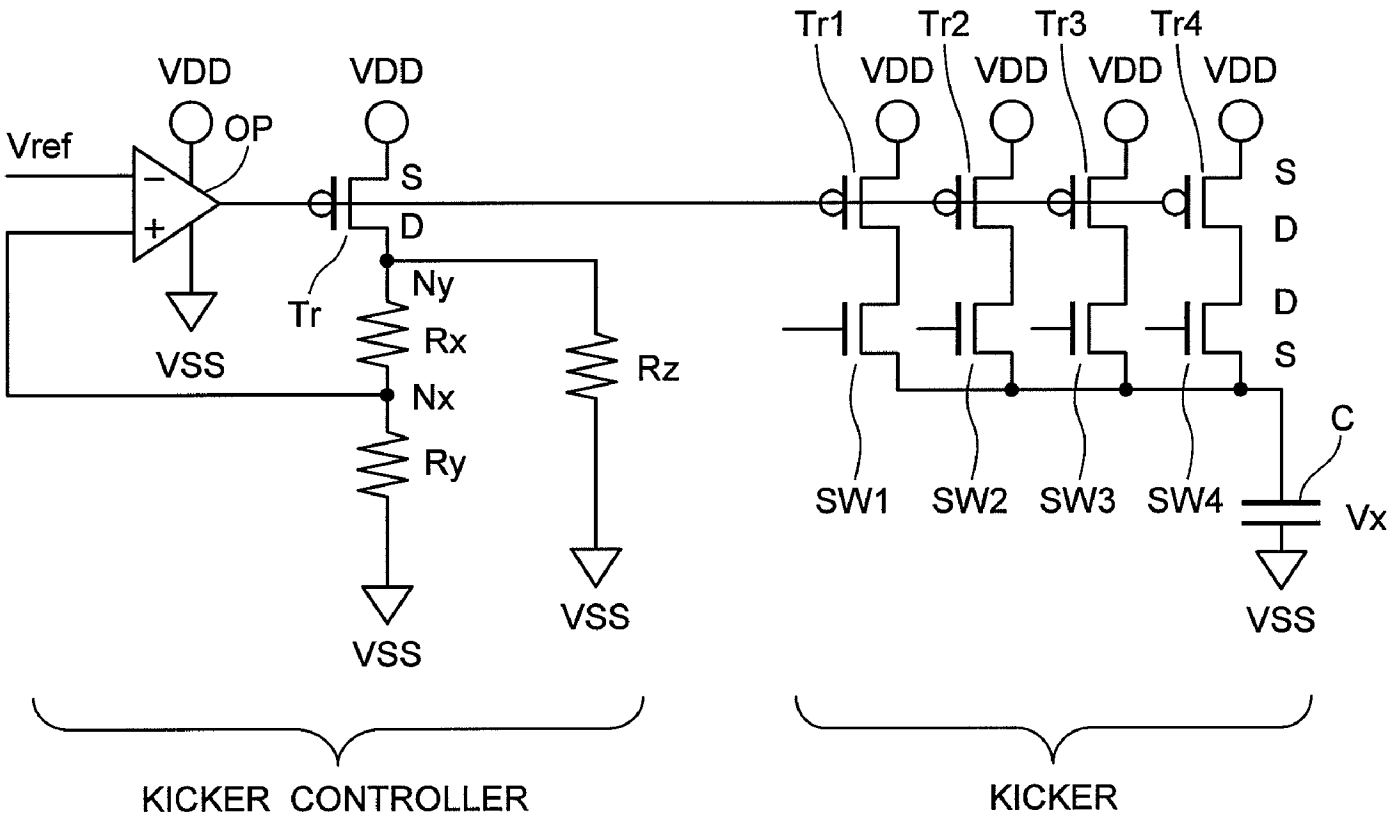
FIG. 7 is a circuit diagram schematically illustrating a configuration of a current supply circuit of a fourth embodiment.

FIG. 7 is a circuit diagram schematically illustrating a configuration of a current supply circuit of a fourth embodiment.

In the present embodiment, the NMOS transistor Tr(N) and the PMOS transistor Tr(P) of the first embodiment are replaced with the transistor Tr which is a PMOS. This is similar to the second embodiment. The transistor Tr is an example of the transistor of the present invention. Further, in the present embodiment, the switching transistors SW1 to SW4 are NMOSs.

In addition to the first and second resistances Rx and Ry, the current supply circuit of FIG. 7 is provided with a third resistance Rz. The third resistance Rz is arranged between the node Ny and the ground line VSS. The node Ny is between the first resistance Rx and the drain terminal of the transistor Tr. The node Ny is an example of another predetermined node in the present invention. In the present embodiment, the resistance Rz is a fixed resistance.

Next, based on the above description, the configuration and operation of the current supply circuit of FIG. 7 will be described in detail.

In the present embodiment, the resistance Rz which is to be offset is arranged. The resistances Rx and Ry for controlling a voltage and the resistance Rz for controlling a current are separately arranged. In the present embodiment, the drain voltage of the transistor Tr is determined by adjusting the resistances Rx and Ry. The current $I_T$ flowing through the transistor Tr is expressed by the following equation (2):

$$I_T = V_D/Rz \quad (2).$$

In this expression, $V_D$ denotes the drain voltage of the transistor Tr. Accordingly, a constant multiplication current thereof flows through the transistors of the kicker side. Therefore, in the present embodiment, the current value flowing through the kicker side can be controlled to a desired value by adjusting the resistance Rz. In this manner, in the present embodiment, the current flowing through the kicker side can be appropriately set. As can be seen from equation (2), in the present embodiment, the current flowing through the kicker side is varied linearly against the variation of the drain voltage $V_D$ of the transistor Tr.

As described above, the current supply circuit of the present embodiment includes the third resistance Rz arranged between the node Ny and the ground line VSS, in addition to the first resistance Rx arranged between the operational amplifier OP and the transistor Tr, and the second resistance Ry arranged between the node Nx and the ground line VSS. Accordingly, in the present embodiment, each of the current flowing through the transistor Tr and the voltage supplied to the transistor Tr can be controlled. In this manner, the present embodiment can provides a current supply circuit having a high degree of flexibility in controlling the current and voltage in the circuit.

Fifth Embodiment

Figure 8:
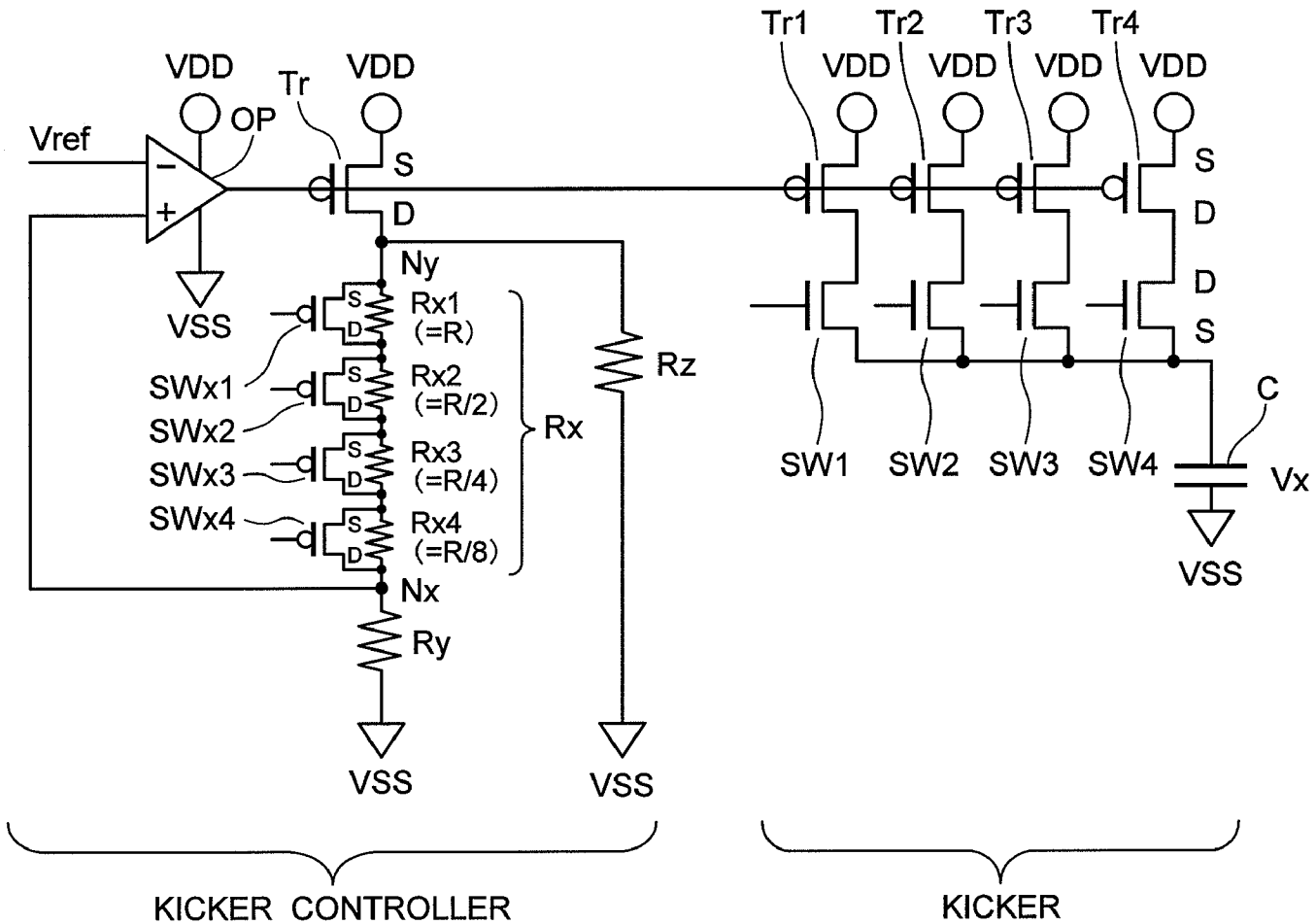
FIG. 8 is a circuit diagram schematically illustrating a configuration of a current supply circuit of a fifth embodiment.

FIG. 8 is a circuit diagram schematically illustrating a configuration of a current supply circuit of a fifth embodiment.

In the present embodiment, the resistance Rx in the fourth embodiment is replaced with first to fourth serial resistances Rx1 to Rx4 which are connected in series to each other. Further, the current supply circuit of the present embodiment includes first to fourth switching transistors SWx1 to SWx4 which are respectively connected to the first to fourth serial resistances Rx1 to Rx4 in parallel.

In the present embodiment, the resistance values of the first to fourth resistances Rx1 to Rx4 are respectively set to R, R/2, R/4, and R/8, where R is an arbitrary positive real number. Accordingly, in the present embodiment, the value of the resistance Rx can be varied in sixteen ($=2^4$) different values in accordance with an ON/OFF operation of the switching transistors SWx1 to SWx4.

The resistances Rx1 to Rx4 are examples of first to $N_1$th serial resistances of the present invention, and the switching transistors SWx1 to SWx4 are examples of first to $N_1$th switching transistors of the present invention, where $N_1$ is an integer of two or larger. The resistance values of the first to $N_1$th serial resistances are set respectively to be R, R/2, R/4, and $R/2^{N1-1}$, for example. In other words, the resistance value of the $K_1$th resistance among the first to $N_1$th serial resistances is set to be $R/2^{K1-1}$, where $K_1$ is an arbitrary integer between 1 and $N_1$ inclusive. Although $N_1$ is four in the present embodiment, $N_1$ may be another integer of being two or larger.

Next, based on the above description, the configuration and operation of the current supply circuit of FIG. 8 will be described in detail.

Figure 9:
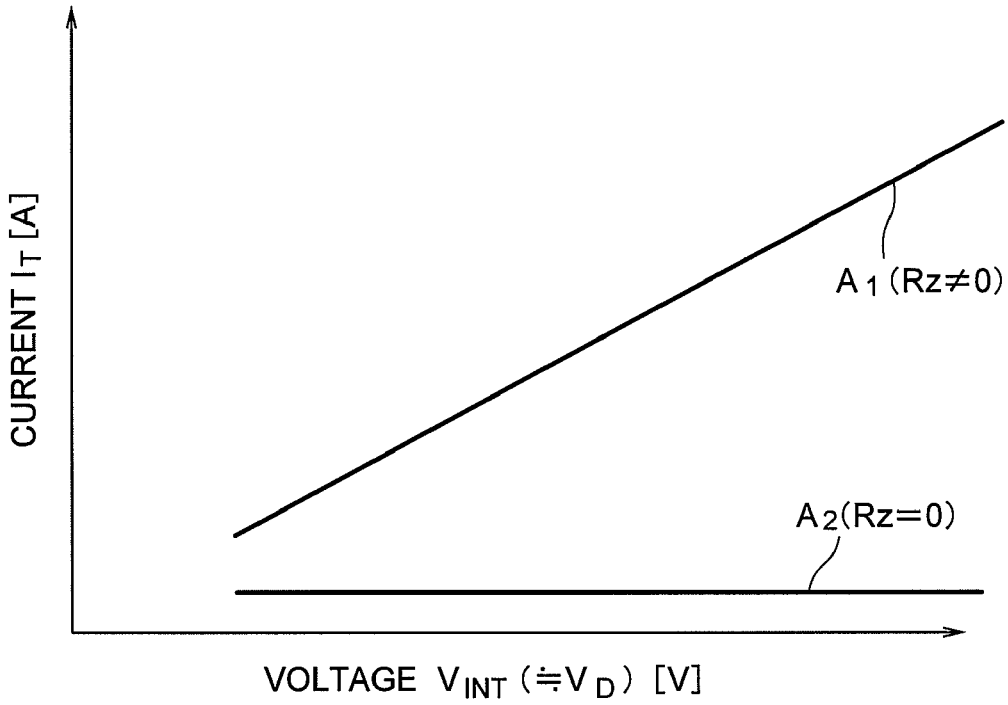
FIG. 9 is a graph indicating a relation between a voltage $V_{INT}$ ($\approx V_D$) at a node Ny and a current $I_T$ flowing through a transistor Tr in the fifth embodiment.

FIG. 9 is a graph indicating the relation between the voltage $V_{INT}$ ($\approx V_D$) at the node Ny and the current $I_T$ flowing through the transistor Tr in the fifth embodiment. A line $A_1$ indicates the $I_T$–$V_{INT}$ characteristics in the case of resistance Rz≠0, and a line $A_2$ indicates the $I_T$–$V_{INT}$ characteristics in the case of Rz=0.

In the present embodiment, when the current flowing through the resistance Rz is to be predominant, the current $I_T$ can be varied linearly against the voltage $V_{INT}$ by appropriately adjusting the resistance Rz. Accordingly, the current flowing at the kicker side can be varied linearly against the voltage $V_{INT}$. An example of the linear variation of the current $I_T$ against the voltage $V_{INT}$ is indicated by the line $A_1$ in FIG. 9.

In the present embodiment, it is desirable that the current flowing through the resistance Rz is the twice or larger of the current flowing through the resistance Rx and Ry. This is because that the current flowing through the resistance Rz is considered to become sufficiently predominant and that the current and voltage are considered to be realistically possible to be separately controlled.

As indicated by the line $A_2$ in FIG. 9, in the case of Rz=0, the current $I_T$ is not varied even when the voltage $V_{INT}$ is varied. Meanwhile, as indicated by the line $A_1$ in FIG. 9, in the case of Rz≠0, the current $I_T$ can be varied linearly against the voltage $V_{INT}$ by appropriately adjusting the resistance Rz.

Similar to the fourth embodiment, the present embodiment can provide a current supply circuit having a high degree of flexibility in controlling the current and voltage in the circuit.

Sixth Embodiment

Figure 10:
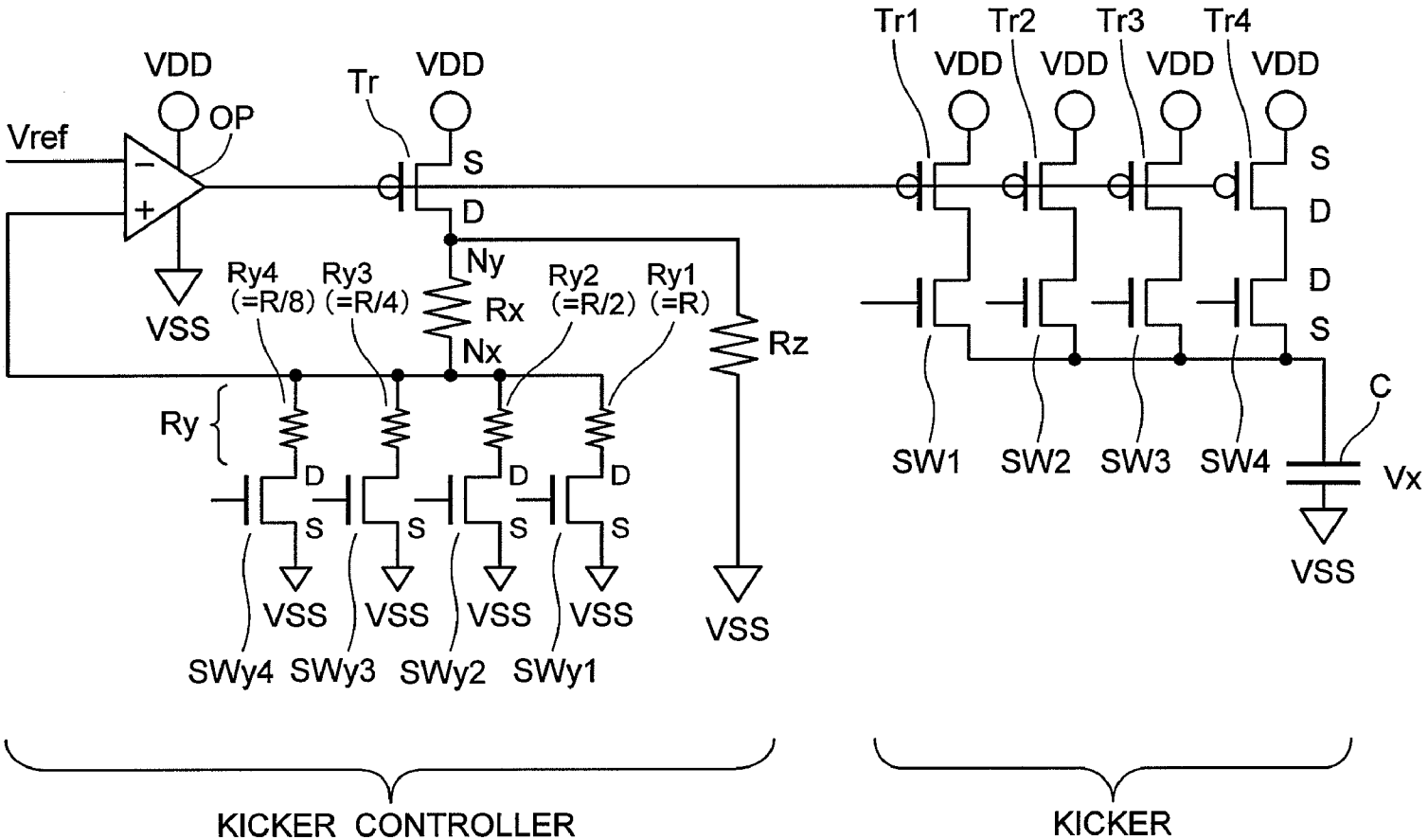
FIG. 10 is a circuit diagram schematically illustrating a configuration of a current supply circuit of a sixth embodiment.

FIG. 10 is a circuit diagram schematically illustrating a configuration of a current supply circuit of a sixth embodiment.

In the present embodiment, the resistance Ry in the fourth embodiment is replaced with first to fourth parallel resistances Ry1 to Ry4 which are connected in parallel to each other. Further, the current supply circuit of the present embodiment includes first to fourth switching transistors SWy1 to SWy4 which are respectively connected in series to the first to fourth parallel resistances Ry1 to Ry4.

In the present embodiment, the resistance values of the first to fourth resistances Ry1 to Ry4 are respectively set to R, R/2, R/4 and R/8, where R is an arbitrary positive real number. Accordingly, in the present embodiment, the value of the resistance Ry can be varied in sixteen ($=2^4$) different values in accordance with an ON/OFF operation of the switching transistors SWy1 to SWy4.

The resistances Ry1 to Ry4 are examples of first to $N_2$th parallel resistances of the present invention, and the switching transistors SWy1 to SWy4 are examples of first to $N_2$th switching transistors of the present invention, where $N_2$ is an integer of two or larger. The resistance values of the first to $N_2$th parallel resistances are set respectively to be R, R/2, R/4, and $R/2^{N2-1}$, for example. In other words, the resistance value of the $K_2$th resistance among the first to $N_2$th parallel resistances is set to be $R/2^{K2-1}$, where $K_2$ is an arbitrary integer between 1 and $N_2$ inclusive. Although $N_2$ is four in the present embodiment, $N_2$ may be another integer of being two or larger.

Next, based on the above description, the configuration and operation of the current supply circuit of FIG. 10 will be described in detail.

In the fifth embodiment, the switching transistors SWx1 to SWx4 are connected in series to each other. Therefore, when the number of the switching transistors increases, the ON-resistance thereof cannot be neglected.

On the contrary, in the present embodiment, the switching transistors SWy1 to SWy4 are connected in parallel to each other. Accordingly, in the present embodiment, even in the case that the number of the switching transistors increases, the ON-resistance thereof remains within a degree to be neglected.

In this manner, according to the present embodiment, the drain voltage $V_D$ of the transistor Tr can be controlled by adjusting the resistances Ry1 to Ry4 while keeping the ON-resistance of the switching transistors SWy1 to SWy4 to be small.

Figure 11:
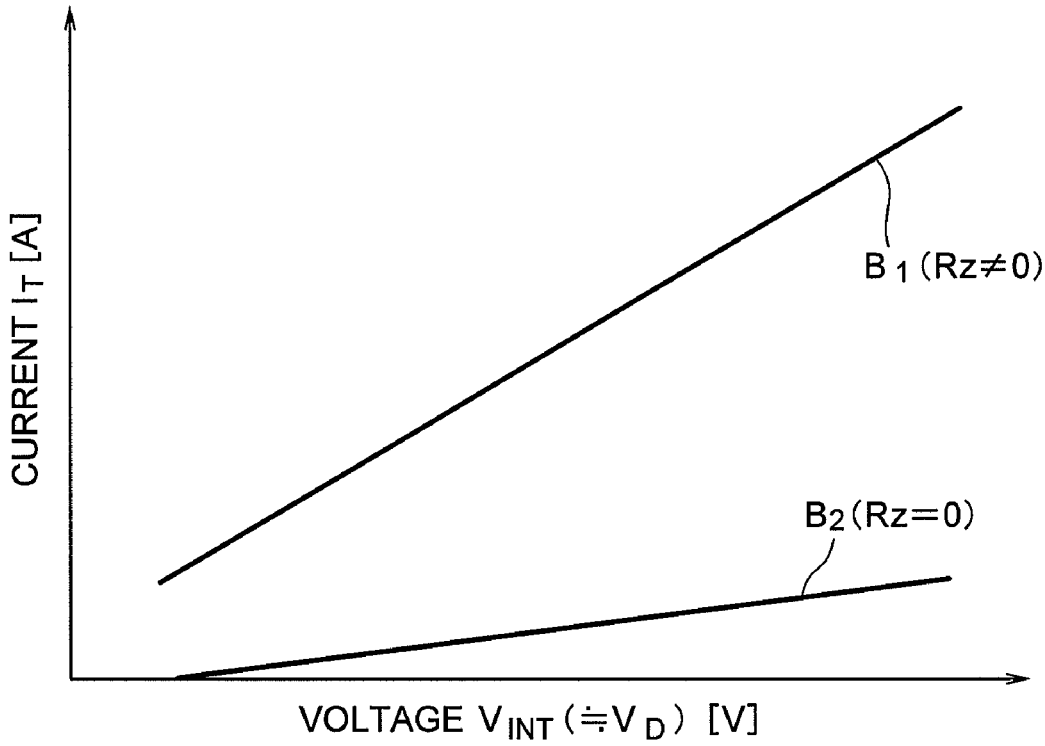
FIG. 11 is a graph indicating a relation between a voltage $V_{INT}$ ($\approx V_D$) at a node Ny and a current $I_T$ flowing through a transistor Tr in the sixth embodiment.

FIG. 11 is a graph indicating the relation between the voltage $V_{INT}$ ($\approx V_D$) at the node Ny and the current $I_T$ flowing through the transistor Tr in the sixth embodiment. A line $B_1$ indicates the $I_T$–$V_{INT}$ characteristics in the case of Rz≠0, and a line $B_2$ indicates the $I_T$–$V_{INT}$ characteristics in the case of Rz=0.

In the present embodiment, by varying the combined resistance of the resistances Ry, the value of the current flowing through the resistances Rx is varied, and the drain voltage $V_D$ of the transistor Tr is varied thereby. As a result, there is a fear that the value of the current $I_T$ flowing through the transistor Tr is varied. However, in this case, by adjusting the resistance value of the resistance Rx so that the current flowing through the resistance Rz is to be predominant, the variation of the value of the current $I_T$ in accordance with the above mentioned variation of the voltage $V_D$ is to be a negligible degree. An example of the $I_T$–$V_{INT}$ characteristics in this case is indicated by the line $B_2$ in FIG. 11.

In the present embodiment, when the current flowing through the resistance Rz is to be predominant, the current $I_T$ can be varied linearly against the voltage $V_{INT}$ by appropriately adjusting the resistance Rz. Accordingly, the current flowing at the kicker side can be varied linearly against the voltage $V_{INT}$. An example of the linear variation of the current $I_T$ against the voltage $V_{INT}$ is indicated by line $B_1$ in FIG. 11.

Similar to the fourth embodiment, the present embodiment can provide a current supply circuit having a high degree of flexibility in controlling the current and voltage in the circuit. Further, in the present embodiment, the ON-resistance of the switching transistors can be kept low even when the number of the switching transistors for the resistances Ry increases.

Seventh Embodiment

Figure 12:
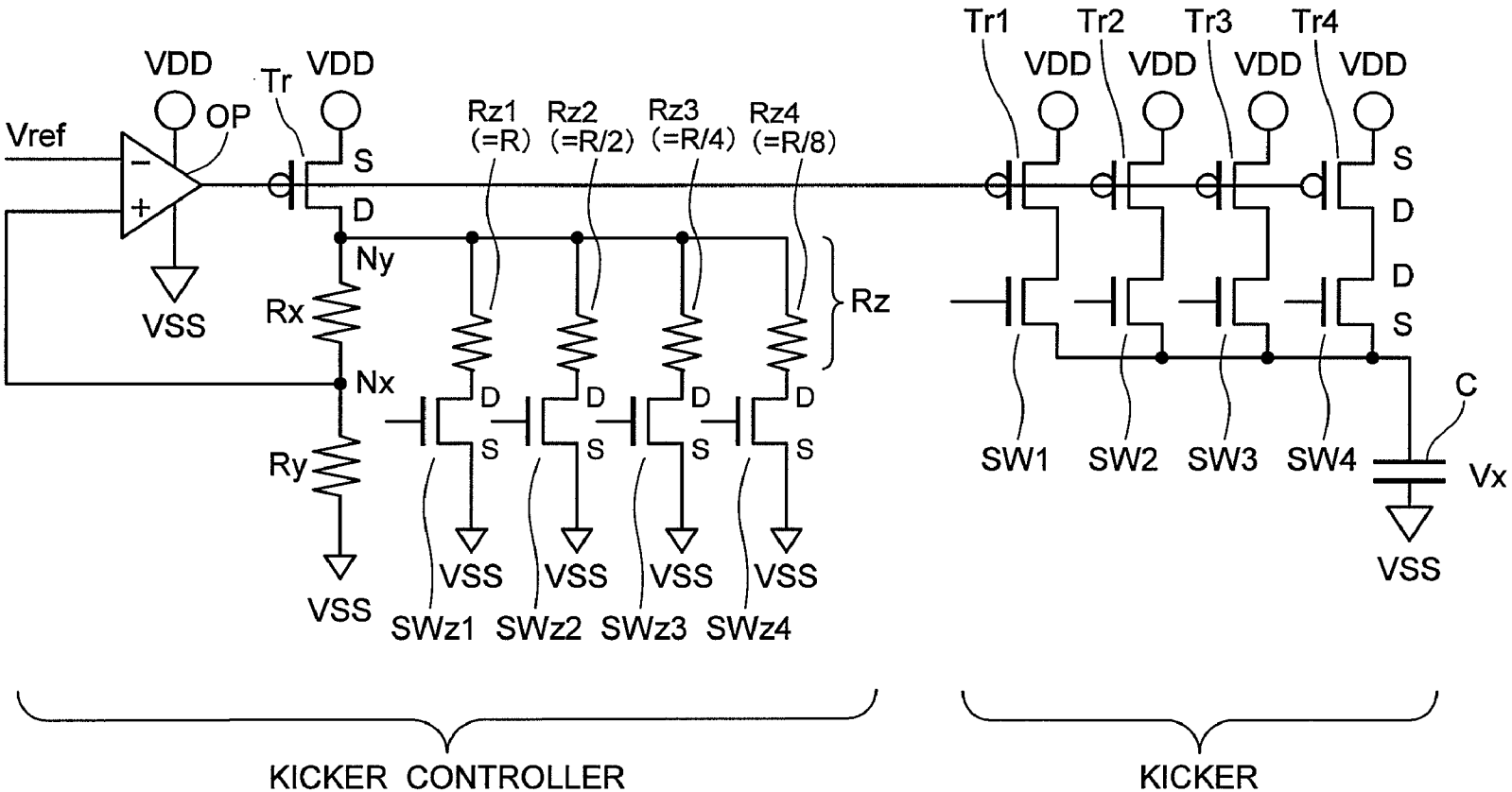
FIG. 12 is a circuit diagram schematically illustrating a configuration of a current supply circuit of a seventh embodiment.

FIG. 12 is a circuit diagram schematically illustrating a configuration of a current supply circuit of a seventh embodiment.

In the present embodiment, the resistance Rz in the fourth embodiment is replaced with first to fourth parallel resistances Rz1 to Rz4 which are connected in parallel to each other. Further, the current supply circuit of the present embodiment includes first to fourth switching transistors SWz1 to SWz4 which are respectively connected in series to the first to fourth parallel resistances Rz1 to Rz4.

In the present embodiment, the resistance values of the first to fourth resistances Rz1 to Rz4 are respectively set to R, R/2, R/4, and R/8, where R is an arbitrary positive real number. Accordingly, in the present embodiment, the value of the resistance Rz can be varied in sixteen ($=2^4$) different values in accordance with an ON/OFF operation of the switching transistors SWz1 to SWz4.

The resistances Rz1 to Rz4 are examples of first to $N_3$th parallel resistances of the present invention, and the switching transistors SWz1 to SWz4 are examples of first to $N_3$th switching transistors of the present invention, where $N_3$ is an integer of two or larger. The resistance values of the first to $N_3$th parallel resistances are set respectively to be R, R/2, R/4, and $R/2^{N3-1}$, for example. In other words, the resistance value of the $K_3$th resistance among the first to $N_3$th parallel resistances is set to be $R/2^{K3-1}$, where $K_3$ is an arbitrary integer between 1 and $N_3$ inclusive. Although $N_3$ is four in the present embodiment, $N_3$ may be another integer of being two or larger.

Next, based on the above description, the configuration and operation of the current supply circuit of FIG. 12 will be described in detail.

In the present embodiment, the resistance Rz is capable of being trimmed. According to the present embodiment, the current flowing at the kicker side can be controlled with the resistance Rz which has a less overhead area and is capable of being simply trimmed.

Figure 13:
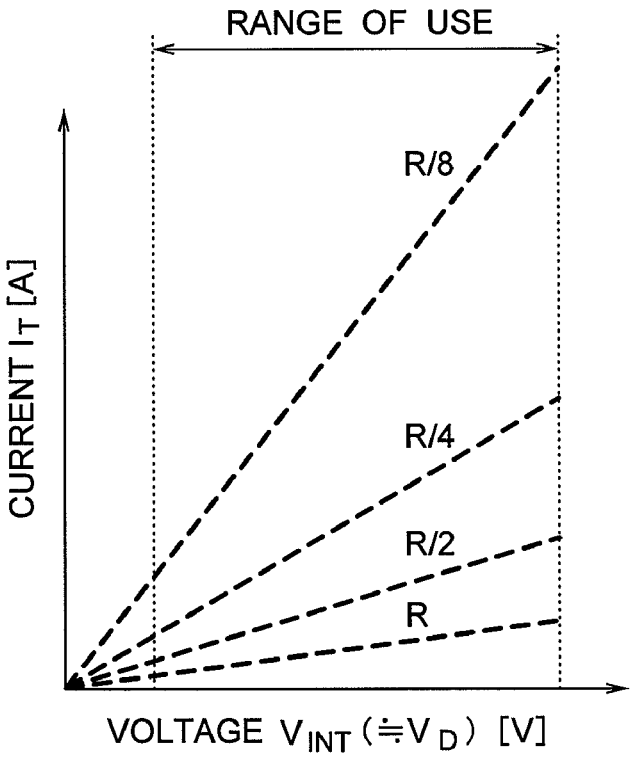
FIG. 13 is a graph indicating a relation between a voltage $V_{INT}$ ($\approx V_D$) at a node Ny and a current $I_T$ flowing through a transistor Tr in the seventh embodiment.

FIG. 13 is a graph indicating the relation between the voltage $V_{INT}$ ($\approx V_D$) at the node Ny and the current $I_T$ flowing through the transistor Tr in the seventh embodiment. In the present embodiment, as indicated in FIG. 13, by changing the resistance selected among the resistances Rz1 to Rz4 from R to R/2, R/4 and R/8, the inclination of the $I_T$–$V_{INT}$ characteristics can be increased to be two-times, four-times and eight-times.

Figure 14:
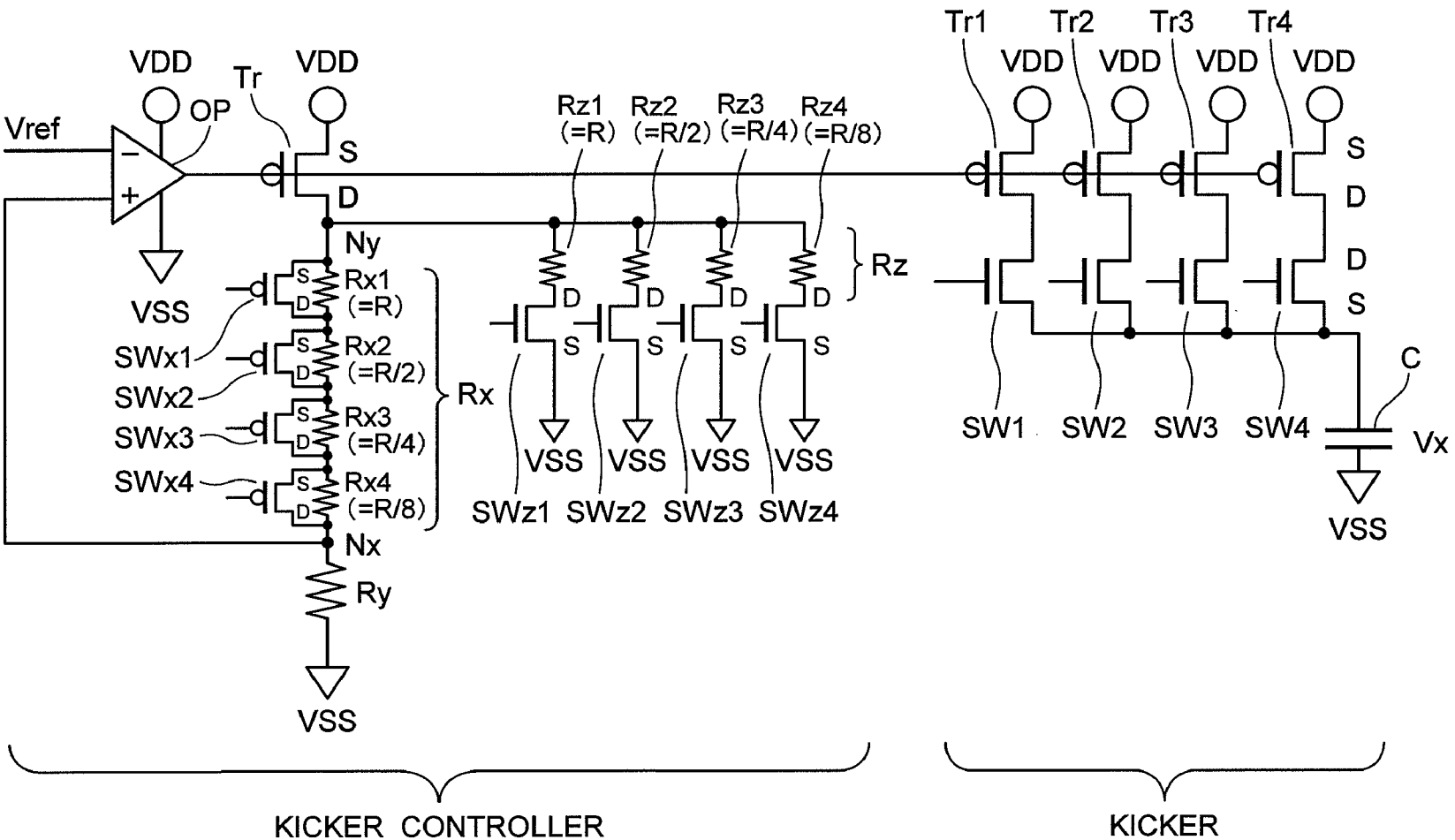
FIGS. 14 to 17 are circuit diagrams schematically illustrating configurations of current supply circuits of first and fourth modifications of the seventh embodiment, respectively.

FIG. 14 is a circuit diagram schematically illustrating a configuration of a current supply circuit of a first modification of the seventh embodiment. In the present modification, in addition to replacing the resistance Rz with the parallel resistances Rz1 to Rz4 as described above, the resistance Rx is replaced with the serial resistances Rx1 to Rx4 as similar to the fifth embodiment.

In the present modification, when the currents flowing through the resistances Rz1 to Rz4 is to be predominant, the current $I_T$ can be varied linearly against the voltage $V_{INT}$ by appropriately adjusting the resistances Rz1 to Rz4. Accordingly, the current flowing at the kicker side can be varied linearly against the voltage $V_{INT}$. This is similar to the fifth embodiment.

Figure 15:
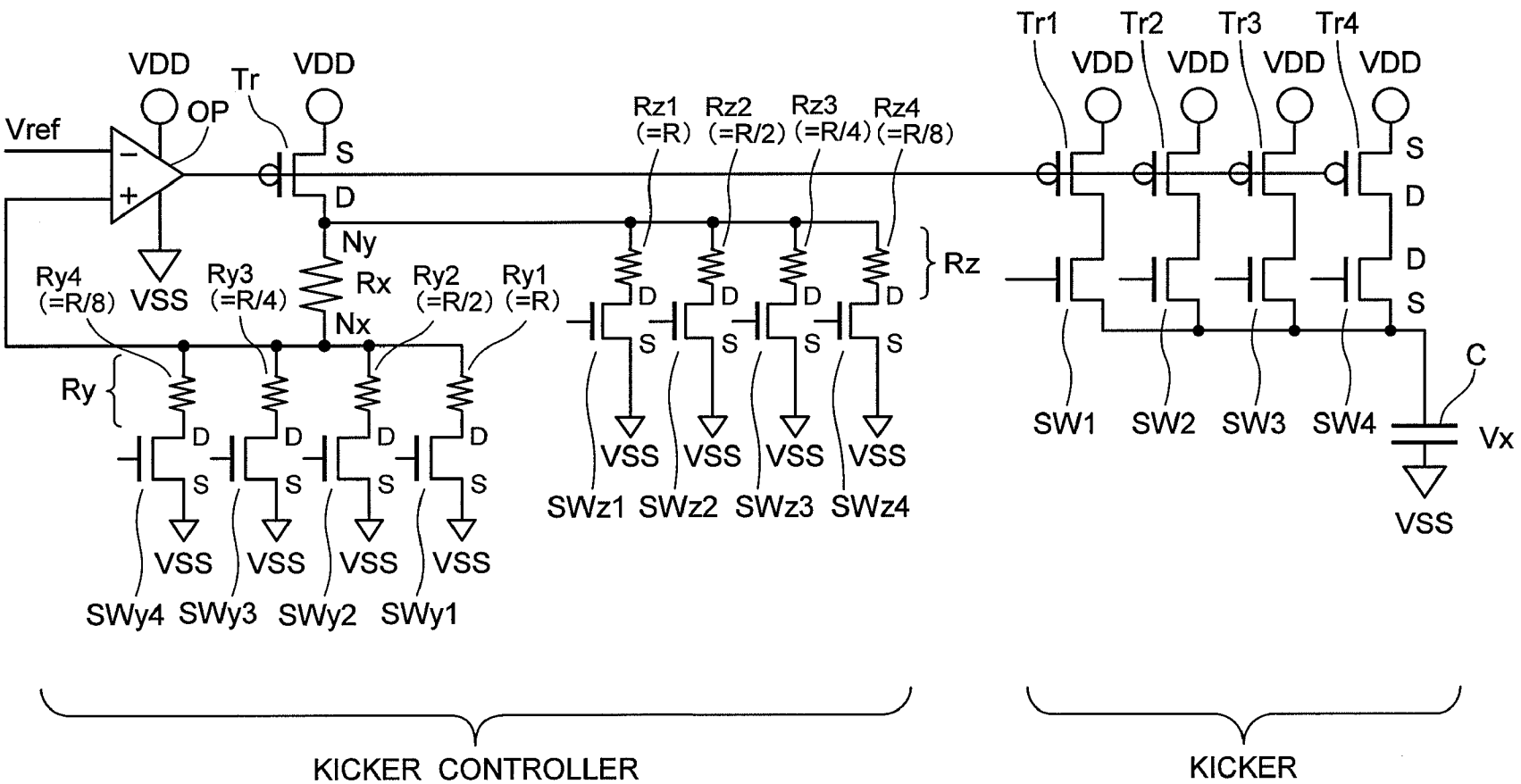

FIG. 15 is a circuit diagram schematically illustrating a configuration of a current supply circuit of a second modification of the seventh embodiment. In the present modification, in addition to replacing the resistance Rz with the parallel resistances Rz1 to Rz4 as described above, the resistance Ry is replaced with the parallel resistances Ry1 to Ry4 as similar to the sixth embodiment.

In the present modification, when the currents flowing through the resistances Rz1 to Rz4 is to be predominant, the current $I_T$ can be varied linearly against the voltage $V_{INT}$ as well by appropriately adjusting the resistances Rz1 to Rz4. Accordingly, the current flowing at the kicker side can be varied linearly against the voltage $V_{INT}$. This is similar to the sixth embodiment.

Figure 16:
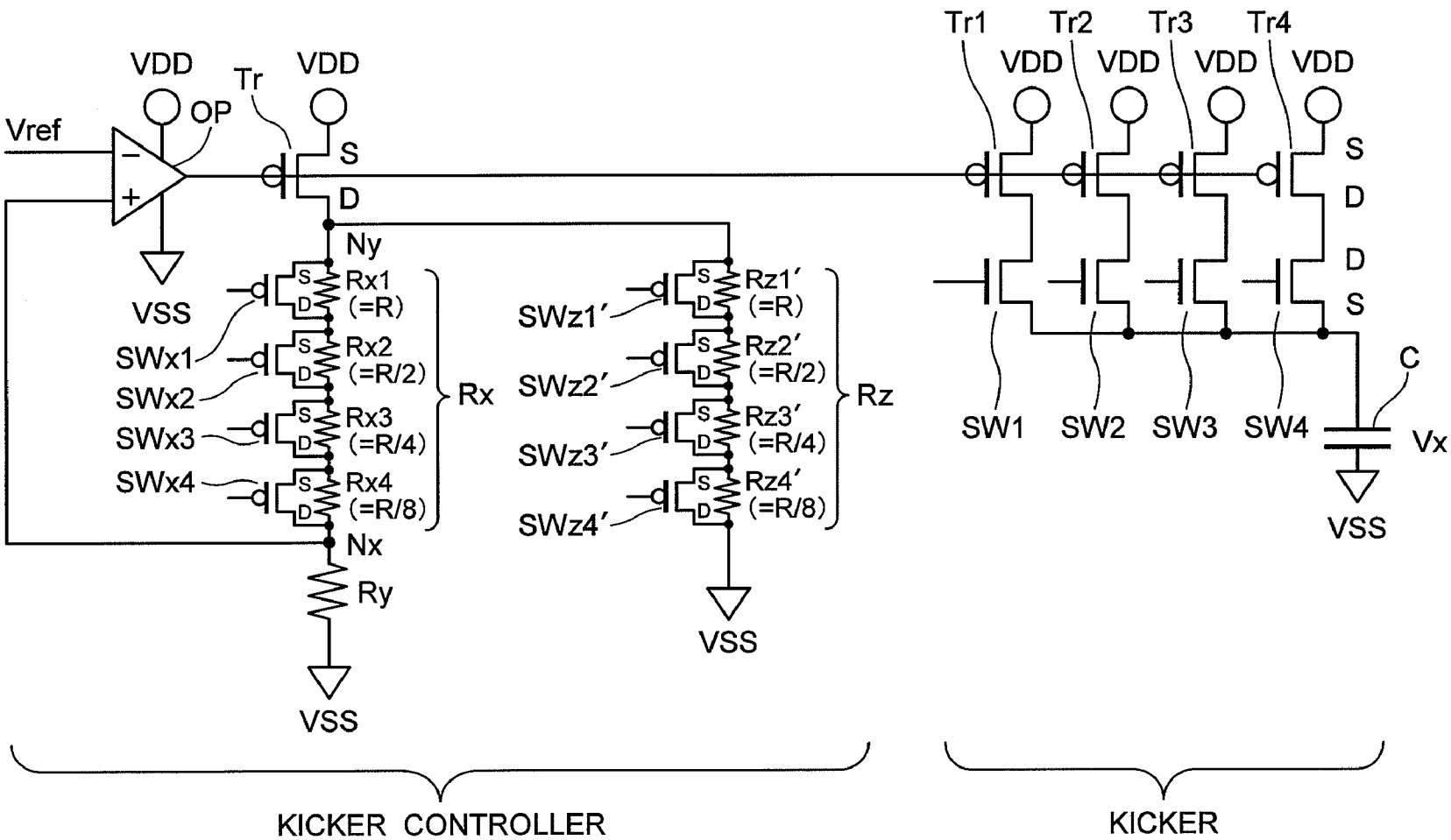

FIG. 16 is a circuit diagram schematically illustrating a configuration of a current supply circuit of a third modification of the seventh embodiment. In the present modification, in addition to replacing the resistance Rx with the serial resistances Rx1 to Rx4 as similar to the first modification, the resistance Rz is replaced with the serial resistances Rz1' to Rz4' not with the parallel resistances Rz1 to Rz4.

In the present modification, when the currents flowing through the resistances Rz1' to Rz4' is to be predominant, the current $I_T$ can be varied linearly against the voltage $V_{INT}$ by appropriately adjusting the resistances Rz1' to Rz4'. Accordingly, the current flowing at the kicker side can be varied linearly against the voltage $V_{INT}$. This is similar to the first modification.

Figure 17:
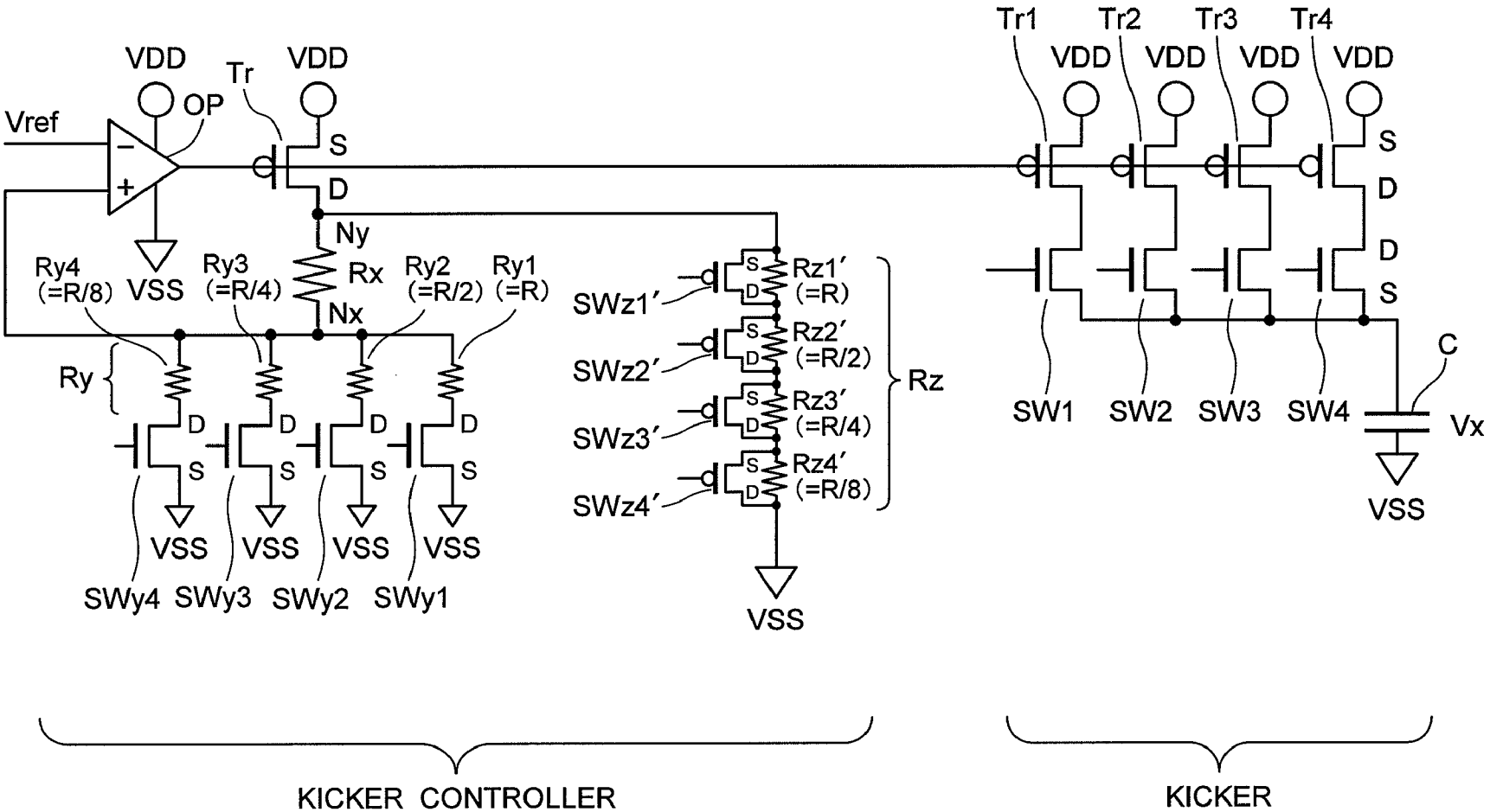

FIG. 17 is a circuit diagram schematically illustrating a configuration of a current supply circuit of a fourth modification of the seventh embodiment. In the present modification, in addition to replacing the resistance Ry with the parallel resistances Ry1 to Ry4 as similar to the second modification, the resistance Rz is replaced with the serial resistances Rz1' to Rz4' not with the parallel resistances Rz1 to Rz4.

In the present modification, when the currents flowing through the resistances Rz1' to Rz4' is to be predominant, the current $I_T$ can be varied linearly against the voltage $V_{INT}$ as well by appropriately adjusting the resistances Rz1' to Rz4'.

Accordingly, the current flowing at the kicker side can be varied linearly against the voltage $V_{INT}$. This is similar to the second modification.

The current supply circuits of the third and fourth modifications respectively include first to fourth switching transistors SWz1' to SWz4'. It is to be noted that the first to fourth switching transistors SWz1' to SWz4' are respectively connected to the first to fourth serial resistances Rz1' to Rz4' in parallel.

In the first to fourth modifications, the relation between the voltage $V_{INT}$ at the node Ny and the current $I_T$ flowing through the transistor Tr is similar to the relation indicated in FIG. 13. Accordingly, in these modifications, by changing a resistance selected among the resistances Rz1 to Rz4 or among the resistances Rz1' to Rz4' from R to R/2, R/4 and R/8, the inclination of the $I_T$–$V_{INT}$ characteristics can be increased to be two-times, four-times and eight-times.

As described above, the current supply circuit of the present embodiment includes the third resistance Rz arranged between the node Ny and the ground line VSS, in addition to the first resistance Rx arranged between the operational amplifier OP and the transistor Tr, and the second resistance Ry arranged between the node Nx and the ground line VSS. Accordingly, similar to the fourth embodiment, the present embodiment can provides a current supply circuit having a high degree of flexibility in controlling the current and voltage in the circuit. Further, in the present embodiment, the current flowing at the kicker side can be controlled by the resistance Rz which has the less overhead area and is capable of being simply trimmed.

Eighth Embodiment

Figure 18:
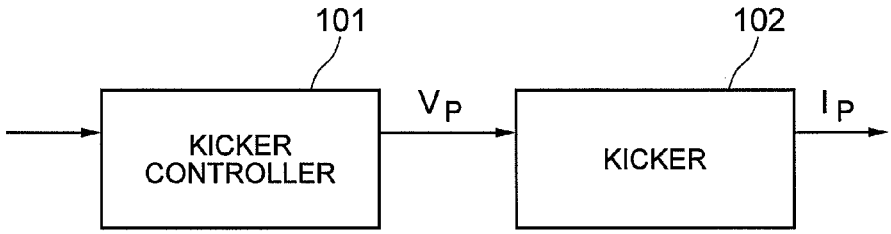
FIG. 18 is a circuit diagram illustrating a current supply circuit in which a kicker controller and a kicker are directly connected.

FIG. 18 is a circuit diagram indicating a current supply circuit in which a kicker controller 101 and a kicker 102 are directly connected. The current supply circuit of FIG. 18 corresponds to an arbitrary current supply circuit described in the first to seventh embodiments.

In FIG. 18, the pulse voltage Vp is generated in the kicker controller 101 and is input to the gate terminal of the PMOS transistor (for example, Tr1 to Tr4 in FIG. 1) in the kicker 102. Then, as illustrated in FIG. 18, the pulse current Ip dependent to the pulse voltage Vp is output from the capacitor (for example, the capacitor C in FIG. 1) in the kicker 102.

Figure 19:
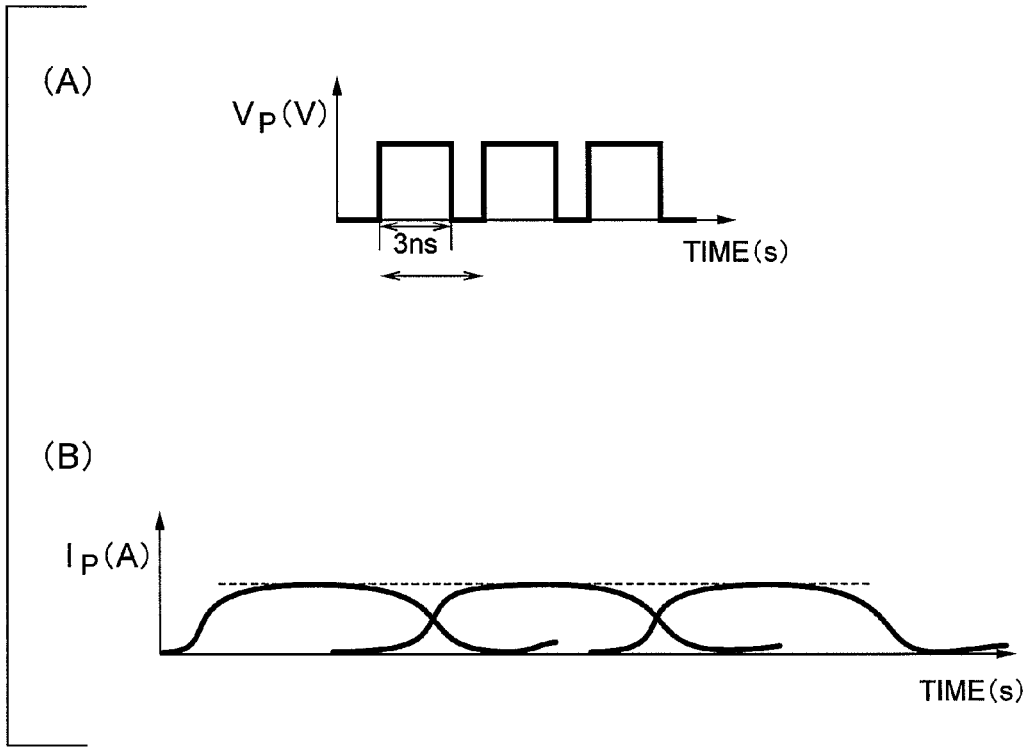
FIG. 19 shows waveform diagrams indicating a pulse voltage Vp and a pulse current Ip.

FIG. 19 shows waveform diagrams indicating the pulse voltage Vp and the pulse current Ip.

In FIG. 19(A), the waveform of the pulse voltage Vp is indicated. In accordance with a characteristic variation of the transistors and resistances and a temperature fluctuation in the current supply circuit, there is a possibility that the pulse width is prolonged and that the waveform become unsharpened. This is the same as well for the pulse width and the waveform of the pulse current Ip.

When the pulse voltage Vp and the pulse current Ip are excessively unsharpened, as indicated in FIG. 19(B), there is a fear that the pulses constituting the pulse current Ip are joined to each other and the supply current is saturated in a high frequency operational range of the current supply circuit.

Figure 20:
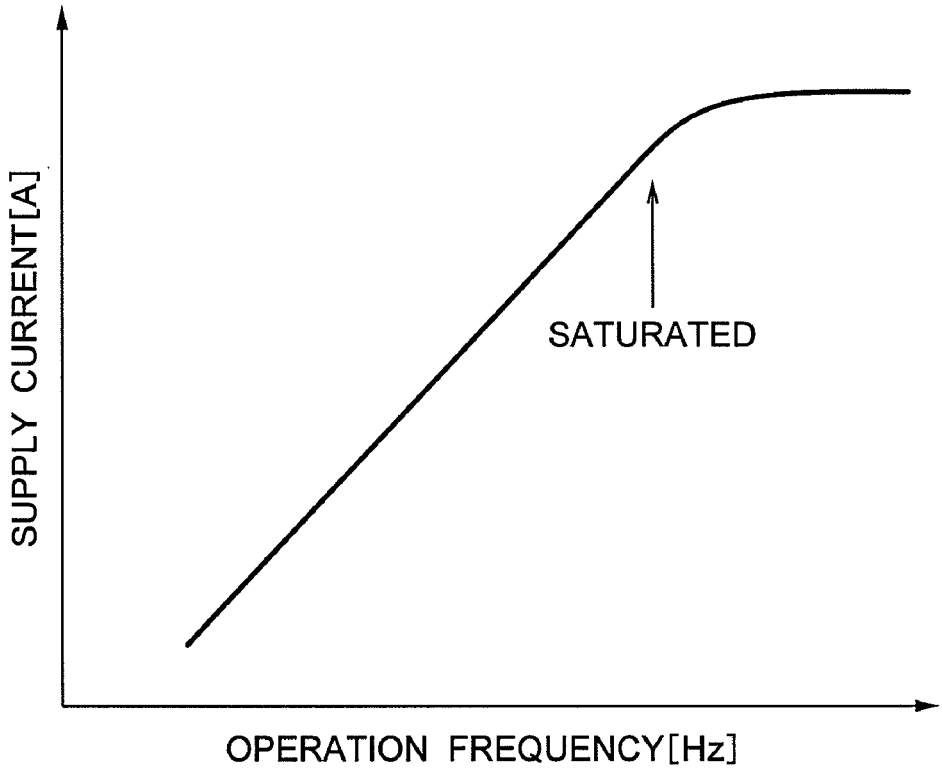
FIG. 20 is a graph indicating frequency dependency of a supply current outputted from the current supply circuit of FIG. 18.

This phenomenon is indicated in FIG. 20. FIG. 20 is a graph indicating frequency dependency of the supply current outputted from the current supply circuit. The horizontal axis of FIG. 20 denotes the operation frequency, and the vertical axis denotes the current value of the supply current output from the current supply circuit.

As can be seen, in a low frequency range of FIG. 20, the supply current is increased along with an increase of the operation frequency. Meanwhile, in a high frequency range of FIG. 20, the linearity thereof is lost and the supply current is saturated against an increase of the operation frequency.

Figure 21:
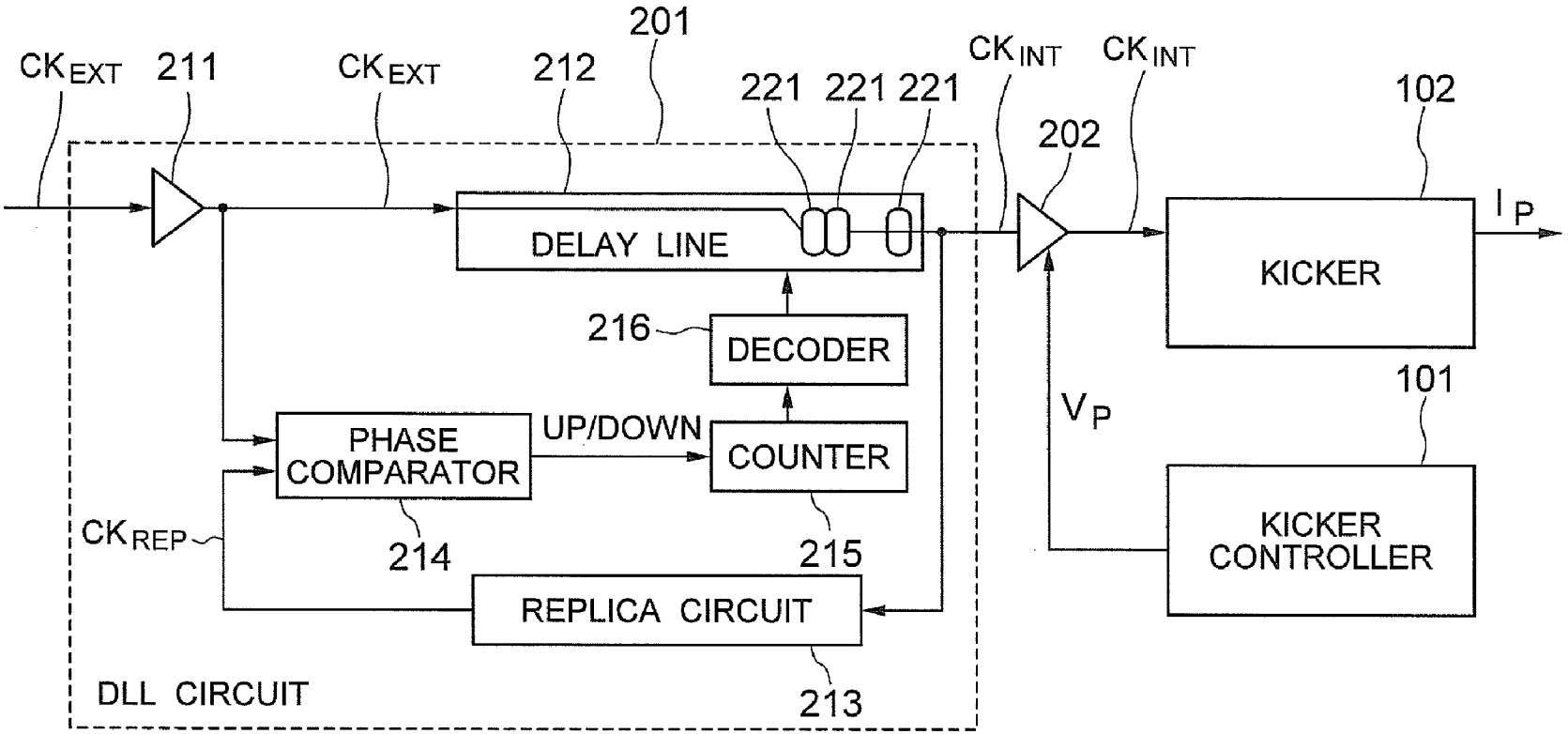
FIG. 21 is a circuit diagram schematically illustrating a configuration of a current supply circuit of a eighth embodiment.

FIG. 21 is a circuit diagram schematically illustrating a configuration of a current supply circuit of a eighth embodiment. In the eighth embodiment, the configuration illustrated in FIG. 21 counters the problem described with reference to FIGS. 18 to 20.

In addition to the arbitrary kicker control circuit 101 and the kicker 102 described in the first to seventh embodiments, the current supply circuit of FIG. 21 includes a delay locked loop (DLL) circuit 201 and a clocked buffer circuit 202.

The DLL circuit 201 is configured to control a delayed amount of a clock signal. The DLL circuit 201 delays internal clock of a circuit element and synchronizes the phase of the internal clock with the phase of an external clock of a circuit element. In FIG. 21, the external clock $CK_{EXT}$ which is input to the DLL circuit 201 and the internal clock $CK_{INT}$ which is output from the DLL circuit 201 while being synchronized with the external clock $CK_{EXT}$ are illustrated.

The clocked buffer circuit 202 is configured to be capable of performing an ON/OFF control by a clock signal. In addition to an input terminal and an output terminal, the clocked buffer circuit 202 includes a control terminal to which the clock signal for the ON/OFF control is provided. In the case that the clock signal is "high", the clocked buffer circuit 202 outputs a signal of "high" when a signal of "high" is input and outputs a signal of "low" when a signal of "low" is input. On the other hand, in the case that the clock signal is "low", the clocked buffer circuit 202 always outputs a signal of "low".

The internal clock $CK_{INT}$ output from the DLL circuit 201 is input to the input terminal of the clocked buffer circuit 202. Further, the pulse voltage Vp output from the kicker controller 101 is supplied to the control terminal of the clocked buffer circuit 202. Furthermore, the output terminal of the clocked buffer circuit 202 is connected to the kicker 102.

Accordingly, the clocked buffer circuit 202 functions as a switching circuit to switch between supplying and not supplying the internal clock $CK_{INT}$ to the kicker 102 based on the ON/OFF control by the pulse voltage Vp. The clocked buffer circuit 202 is operated to supply the internal clock $CK_{INT}$ to the kicker 102 when the pulse voltage Vp is ON, and not to supply the internal clock $CK_{INT}$ to the kicker 102 when the pulse voltage Vp is OFF. The internal clock $CK_{INT}$ output from the clocked buffer circuit 202 is input to the gate terminal of the PMOS transistor (for example, Tr1 to Tr4 in FIG. 1) in the kicker 102. The switching circuit may also be realized by a circuit other than the clocked buffer circuit 202.

Next, advantages of the circuit configuration of the present embodiment illustrated in FIG. 21 will be described.

In the present embodiment, the kicker 102 is supplied with the internal clock $CK_{INT}$ not with the pulse voltage Vp. Accordingly, in the present embodiment, the voltage supplied to the kicker 102 is not affected by the characteristic variation of the transistors and resistances and the temperature fluctuation in the current supply circuit.

Further, in the present embodiment, controlling of supplying or not supplying the internal clock $CK_{INT}$ to the kicker 102 is performed with the pulse voltage Vp. Then, similar to the pulse voltage Vp in the first to seventh embodiments, the internal clock $CK_{INT}$ is input to the gate terminal of the PMOS transistor (for example, Tr1 to Tr4 in FIG. 1) in the kicker 102.

Figure 22:
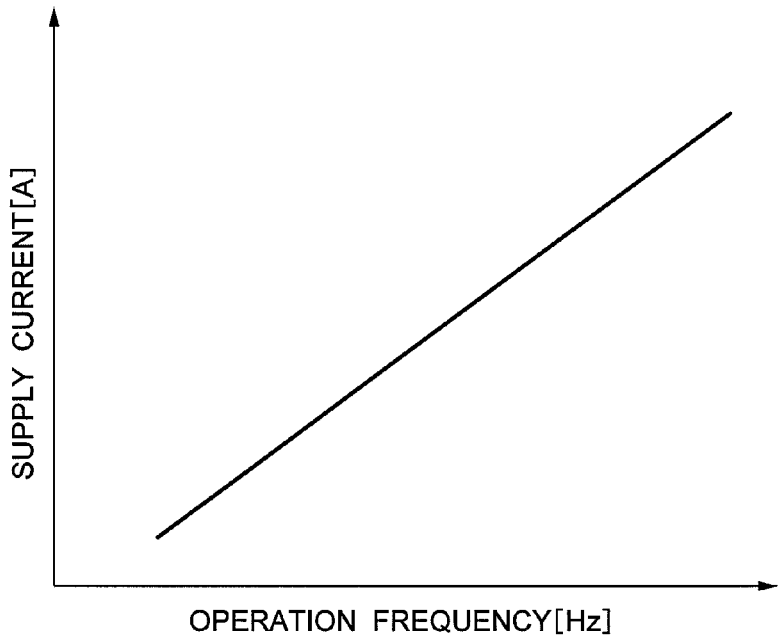
FIG. 22 is a graph indicating frequency dependency of a supply current outputted from the current supply circuit of the eighth embodiment.

As a result, in the present embodiment, an F-I (frequency/supply current) characteristics as indicated in FIG. 22 is obtained. FIG. 22 is a graph indicating a frequency dependency of the supply current outputted from the current supply circuit of FIG. 21.

Similar to the first to seventh embodiments, in the present embodiment, the supply current is linearly increased in accordance with an increase of the operation frequency as illustrated in FIG. 22 since the timing to supply the voltage to the kicker 102 is determined by the pulse voltage Vp.

Meanwhile, in the present embodiment, the internal clock $CK_{INT}$ is supplied to the kicker 102 under the control with the pulse voltage Vp. Therefore, affecting of the characteristic variation of the transistors and resistances and the temperature fluctuation in the current supply circuit to the pulse current Ip is suppressed, and saturation of the supply current in the high frequency range is suppressed as illustrated in FIG. 22.

In the following, the configuration of the DLL circuit 201 of FIG. 21 will be described in detail.

As illustrated in FIG. 21, the DLL circuit 201 includes an input circuit 211, a delay line 212, a replica circuit 213, a phase comparator 214, a counter 215, and a decoder 216.

The external clock $CK_{EXT}$ is input to the input circuit 211. The input circuit 211 outputs the external clock $CK_{EXT}$ to the delay line 212 and the phase comparator 214.

The delay line 212 generates a plurality of delay signals of the external clock $CK_{EXT}$. Then, the delay line 212 selects one delay signal among these delay signals and outputs the selected delay signal to the replica circuit 213. The delay line 212 includes a plurality of delay units 221 which are connected in series to each other. One delay signal is output from each delay unit 221. The delay signal to be output from the delay line 212 is selected in accordance with a control signal from the decoder 216.

The replica circuit 213 adjusts the phase of the input delay signal and generates a signal $CK_{REP}$ to be a subject of the phase comparison. The signal $CK_{REP}$ is output to the phase comparator 214.

The phase comparator 214 compares the phase of the external clock $CK_{EXT}$ input from the input circuit 211 with the phase of the signal $CK_{REP}$ input from the replica circuit 213, and outputs a signal (i.e., an UP-signal or a DOWN-signal) including the comparison result to the counter 215.

The UP-signal is output when the phase of the signal $CK_{REF}$ is smaller than the phase of the external clock $CK_{EXT}$, and then, the phase of the signal $CK_{REF}$ is to be increased accordingly. On the other hand, the DOWN-signal is output when the phase of the signal $CK_{REF}$ is larger than the phase of the external clock $CK_{EXT}$, and then, the phase of the signal $CK_{REF}$ is to be decreased accordingly. The magnitude of the value held by the respective UP-signal and DOWN signal denotes a magnitude of the phase difference between the signal $CK_{REF}$ and the external clock $CK_{EXT}$. The increasing amount or decreasing amount of the phase of the signal $CK_{REF}$ is controlled in accordance with this value.

The counter 215 counts a value of the signal from the phase comparator 214, and outputs a signal including the count result to the decoder 216.

The decoder 216 generates the control signal to control the delay line 212 based on the signal from the counter 215, and outputs the control signal to the delay line 212. The decoder 216 generates the control signal to select a smaller-phase delay signal when the phase of the signal $CK_{REP}$ is larger than the phase of the external clock $CK_{EXT}$, and generates the control signal to select a larger-phase delay signal when the phase of the signal $CK_{REP}$ is smaller than the phase of the external clock $CK_{EXT}$.

The DLL circuit 201 is locked in a state that the comparison result of the phase comparator 214 is matched. Meanwhile, the replica circuit 213 adjusts the phase of the signal $CK_{REP}$ so that the comparison result of the phase comparator 214 is to be matched when the phase of the input delay signal is matched to the phase of the undelayed internal clock. Accordingly, the DLL circuit 201 is locked in a state that the phase of the delay signal output from the delay line 212 is matched to the phase of the undelayed internal clock.

The above operation corresponds to synchronizing the phase of the internal clock with the phase of the external clock $CK_{EXT}$ by delaying the undelayed internal clock toward the delay signal output from the delay line 212. Accordingly, when the DLL circuit 201 is locked, the delay signal of the external clock $CK_{EXT}$, which corresponds to the internal clock $CK_{INT}$ synchronized with the external clock $CK_{EXT}$, is output from the delay line 212. The internal clock $CK_{INT}$ output from the delay line 212 is output to the clocked buffer circuit 202.

In this manner, the DLL circuit 201 outputs the internal clock $CK_{INT}$ which is synchronized with the external clock $CK_{EXT}$.

As described above, in the present embodiment, the PMOS transistor (for example, Tr1 to Tr4 in FIG. 1) in the kicker 102 is supplied with the internal clock $CK_{INT}$ not with the pulse voltage Vp. Then, controlling of supplying or not supplying the internal clock $CK_{INT}$ to the kicker 102 is performed with the pulse voltage Vp. Accordingly, in the present embodiment, it becomes possible to suppress the affecting to the pulse current Ip caused by the characteristic variation of the transistors and resistances in the current supply circuit and the temperature fluctuation.

As described above, according to the embodiments of the present invention, it becomes possible to provide a current supply circuit having excellent responsibility and a high degree of flexibility in controlling a current and a voltage in the circuit.

Although the first to eighth embodiments have been described by way of specific examples of the present invention, the present invention is not limited to those embodiments.

The invention claimed is:

1. A current supply circuit comprising:

an operational amplifier comprising first and second input terminals and an output terminal;

a transistor comprising a control terminal electrically connected to the output terminal of the operational amplifier, and comprising first and second main terminals;

a first resistance between the first input terminal of the operational amplifier and the first main terminal of the transistor;

a second resistance between a predetermined node and a ground line, wherein the predetermined node is between the first input terminal of the operational amplifier and the first resistance;

first to Nth transistors, each of which comprises a control terminal electrically connected to the control terminal or the second main terminal of the transistor, and comprises a main terminal configured to output a current, where N is an integer of two or larger; and first to Nth switching transistors, each of which comprises a main terminal, wherein the main terminals of the first to Nth switching transistors are respectively electrically connected to the main terminals of the first to Nth transistors, a control terminal of the respective first to Nth switching transistors configured to receive a pulse width of a signal, wherein the pulse width is set to be constant regardless of a pulse frequency of the signal.

2. The circuit of claim 1, wherein a Kth transistor among the first to Nth transistors is configured to output the current of $I/2^{K-1}$ from the main terminal, where K is an arbitrary integer between 1 to N, and I is an arbitrary real number other than zero.

3. The circuit of claim 1, further comprising:

a capacitor electrically connected to another main terminal of the respective first to Nth switching transistors.

4. The circuit of claim 3, wherein the second input terminal of the operational amplifier is configured to be supplied by a reference potential independent from a capacitor voltage of the capacitor.

5. The circuit of claim 3, wherein the second input terminal of the operational amplifier is configured to be supplied by a capacitor voltage of the capacitor.

6. The circuit of claim 1, further comprising:

a further transistor comprising a control terminal and a first main terminal which are electrically connected to the second main terminal of the transistor, and comprising a second main terminal which is electrically connected to a power line.

7. The circuit of claim 1, further comprising:

a further transistor comprising a control terminal and a first main terminal which are electrically connected to the first main terminal of the transistor, and comprising a second main terminal which is electrically connected to the first resistance.

8. A current supply circuit comprising:

an operational amplifier comprising first and second input terminals and an output terminal;

a switching transistor comprising a control terminal and first and second main terminals;

a first resistance between the first input terminal of the operational amplifier and the first or second main terminal of the switching transistor;

a second resistance between a predetermined node and a ground line, wherein the predetermined node is between the first input terminal of the operational amplifier and the first resistance;

first to Nth transistors, each of which comprises a control terminal electrically connected to the output terminal of the operational amplifier, and comprises a main terminal configured to output a current, where N is an integer of two or larger; and first to Nth switching transistors, each of which comprises a main terminal, where the main terminals of the first to Nth switching transistors are respectively electrically connected to the main terminals of the first to Nth transistors, a control terminal of the respective first to Nth switching transistors configured to receive a pulse width of a signal, wherein the pulse width is set to be constant regardless of a pulse frequency of the signal.

9. The circuit of claim 8, further comprising:

a capacitor electrically connected to another main terminal of the respective first to Nth switching transistors.

10. The circuit of claim 9, wherein the second input terminal of the operational amplifier is configured to be supplied by a reference potential independent from a capacitor voltage of the capacitor.

11. The circuit of claim 9, wherein the first main terminal of the switching transistor is electrically connected to the first resistance, and the second main terminal of the switching transistor is configured to be supplied by a capacitor voltage of the capacitor.

12. A current supply circuit comprising:

an operational amplifier comprising first and second input terminals and an output terminal;

a transistor comprising a control terminal electrically connected to the output terminal of the operational amplifier, and comprising first and second main terminals;

a first resistance between the first input terminal of the operational amplifier and the first main terminal of the transistor;

a second resistance between a predetermined node and a ground line, wherein the predetermined node is between the first input terminal of the operational amplifier and the first resistance;

a third resistance between another predetermined node and the ground line, the another predetermined node between the first resistance and the first main terminal of the transistor;

first to Nth transistors, each of which comprises a control terminal electrically connected to the control terminal or the second main terminal of the transistor, and comprises a main terminal configured to output a current, where N is an integer of two or larger; and first to Nth switching transistors, each of which comprises a main terminal, wherein the main terminals of the first to Nth switching transistors are respectively electrically connected to the main terminals of the first to Nth transistors.

13. The circuit of claim 12, wherein the first resistance comprises first to $N_1$th serial resistances electrically connected in series to each other, where $N_1$ is an integer of two or larger, and the circuit further comprises first to $N_1$th switching transistors respectively electrically connected in parallel to the first to $N_1$th serial resistances.

14. The circuit of claim 13, wherein a resistance value of a $K_1$th resistance among the first to $N_1$th serial resistances is $R_1/2^{K1-1}$, where $K_1$ is an arbitrary integer between 1 and $N_1$, and $R_1$ is an arbitrary positive real number.

15. The circuit of claim 12, wherein the second resistance comprises first to $N_2$th parallel resistances electrically connected in parallel to each other, where $N_2$ is an integer of two or larger, and the circuit further comprises first to $N_2$th switching transistors respectively electrically connected in series to the first to $N_2$th serial resistances.

16. The circuit of claim 15, wherein a resistance value of a $K_2$th resistance among the first to $N_2$th parallel resistances is $R_2/2^{K2-1}$, where $K_2$ is an arbitrary integer between 1 and $N_2$, and $R_2$ is an arbitrary positive real number.

17. The circuit of claim 12, wherein the third resistance comprises first to $N_3$th parallel or serial resistances electrically connected in parallel or series to each other, where $N_3$ is an integer of two or larger, and the circuit further comprises first to $N_3$th switching transistors respectively electrically connected in series or parallel to the first to $N_3$th parallel or serial resistances.

18. The circuit of claim 17, wherein a resistance value of a $K_3$th resistance among the first to $N_3$th parallel or serial resistances is $R_3/2^{K3-1}$, where $K_3$ is an arbitrary integer between 1 and $N_3$, and $R_3$ is an arbitrary positive real number.

19. A current supply circuit comprising:

a kicker controller configured to output a pulse voltage;

a kicker comprising first to Nth transistors, each of which comprises a main terminal configured to output a current, and first to Nth switching transistors, each of which comprises a main terminal, wherein the main terminals of the first to Nth switching transistors are respectively electrically connected to the main terminals of the first to Nth transistors, where N is an integer of two or larger;

a delay locked loop circuit configured to receive an external clock and to output an internal clock synchronized with the external clock; and a switching circuit configured to switch between supplying and not supplying the internal clock to the kicker, based on the pulse voltage, the switching circuit configured to supply the internal clock to a control terminal of the respective first to Nth transistors.

20. The circuit of claim 19, wherein the switching circuit comprises a control terminal to which the pulse voltage is supplied, an input terminal configured to receive the internal clock, and an output terminal configured to output the internal clock, based on an ON/OFF control by the pulse voltage.

* * * * *